US012582863B2

(12) United States Patent
Tellam et al.

(10) Patent No.: US 12,582,863 B2
(45) Date of Patent: Mar. 24, 2026

(54) PIVOTABLE EXERCISE PAD

(71) Applicant: Custom Product Innovations, Inc., Lebanon, IL (US)

(72) Inventors: Dylan John Tellam, St. Louis, MO (US); Austin Wayne McCarter, O'Fallon, IL (US)

(73) Assignee: Custom Product Innovations, Inc., Lebanon, IL (US)

( * ) Notice: Subject to any disclaimer, the term of this patent is extended or adjusted under 35 U.S.C. 154(b) by 55 days.

(21) Appl. No.: 18/413,595

(22) Filed: Jan. 16, 2024

(65) Prior Publication Data

US 2025/0229118 A1 Jul. 17, 2025

(51) Int. Cl.
*A63B 21/078* (2006.01)
*A63B 21/072* (2006.01)
*A63B 23/04* (2006.01)

(52) U.S. Cl.
CPC ..... *A63B 21/0783* (2015.10); *A63B 21/0724* (2013.01); *A63B 23/0482* (2013.01)

(58) Field of Classification Search
CPC ..... A63B 21/0783; A63B 21/0724
See application file for complete search history.

(56) References Cited

U.S. PATENT DOCUMENTS 4,327,908 A * 5/1982 James ..... A63B 21/0724 482/139
4,722,524 A * 2/1988 Waszkelewicz ... A63B 21/4005 482/106
6,676,575 B1 * 1/2004 Mayo ..... A63B 23/0211 482/148
9,138,613 B2 9/2015 Ferrell
10,765,909 B2 * 9/2020 Wiegman ..... A63B 21/4034
11,896,889 B2 * 2/2024 Stubbers ..... A63B 71/1225
2018/0021662 A1 * 1/2018 Carpinelli ..... A63B 21/0726 482/104
2025/0073523 A1 * 3/2025 Tyree ..... A63B 21/078

OTHER PUBLICATIONS

Taview, Bench Press Block, Published: May 18, 2023, <URL: https://www.amazon.com/dp/B0C5MHMSP5/ > (Year: 2023).*
Taview, Bench Press Block, Published: May 18, 2023, <https://www.amazon.com/dp/B0C5MHMWKJ/?th=1> (Taview 2) (Year: 2023 ).*
The Neuro Strength, Barbell Block Hip Thrusts, Published: Oct. 2, 2022, <URL: https://www.youtube.com/watch?v=TOeOc4GZHBw> (Year: 2022).*

(Continued)

*Primary Examiner* — Zachary T Moore
(74) *Attorney, Agent, or Firm* — Sheehan Phinney Bass & Green PA

(57) ABSTRACT

An exercise pad includes a body with a first major surface, a second major surface parallel (and opposite) to the first major surface, and side surfaces that extend between the first major surface and the second major surface. A groove is formed in the first major surface of the body. The groove extends across the body in a longitudinal direction from a first one of the side surfaces to a second one of the side surfaces that is opposite to and parallel to the first one of the side surfaces. The groove is configured (e.g., with a keyhole-style cross-sectional shape) to receive and engage an elongate bar.

36 Claims, 20 Drawing Sheets

(56) References Cited

OTHER PUBLICATIONS

Booty by Bret; BC Strength Thruster Pad Bar; https://www.bcstrength.com/products/thruster-pad-bar?_pos=1&_sid=31af00502&_ss=r Jan. 2023; retrieved Nov. 16, 2023.
Bench Bloxz; Bench Blok; https://benchblokz.com/pages/bench-blokz Jan. 2023; retrieved Nov. 16, 2023.
Booty by Bret; BC Strength Thruster 3.0; https://www.bcstrength.com/products/thruster-3-0 Jan. 2023; retrieved Nov. 16, 2023.

* cited by examiner

TOP VIEW

PIVOTABLE EXERCISE PAD

BACKGROUND

Strength training involves the performance of physical exercises that are designed to improve strength, endurance, and/or physical appearance. Hip thrusts, for example, are a form of exercise that trains the area surrounding the hips and buttocks. Typically, to perform a hip thrust, the athlete will get into a reclined position and thrust their hips upward to lift his or her lap with or without weight balanced thereupon.

SUMMARY OF THE INVENTION

In one aspect, an exercise pad includes a body with a first major surface, a second major surface parallel (and opposite) to the first major surface, and side surfaces that extend between the first major surface and the second major surface. A groove is formed in the first major surface of the body. The groove extends across the body in a longitudinal direction from a first one of the side surfaces to a second one of the side surfaces that is opposite to and parallel to the first one of the side surfaces. The groove is configured (e.g., with a keyhole-style cross-sectional shape) to receive and engage an elongate bar.

In another aspect, an assembly includes: a support structure (e.g., a weightlifting rack or hooks connected to or forming a part of the weightlifting rack), an elongate cylindrical bar (e.g., a barbell) supported by the support structure, and an exercise pad coupled to the elongate cylindrical bar. The exercise pad includes a body with a first major surface, a second major surface parallel (and opposite) to the first major surface, and side surfaces that extend between the first major surface and the second major surface. A groove is formed in the first major surface of the body. The groove extends across the body in a longitudinal direction from a first one of the side surfaces to a second one of the side surfaces that is opposite to and parallel to the first one of the side surfaces. The groove is configured (e.g., with a keyhole-style cross-sectional shape) to receive and engage an elongate bar. The exercise pad is coupled to the elongate cylindrical bar by virtue of the elongate cylindrical bar having been positioned inside the groove of the exercise pad so as to extend in the longitudinal direction.

In yet another aspect, a method of exercising includes positioning an elongate cylindrical bar (e.g., a barbell) on a support structure (e.g., a weightlifting rack or hooks connected to or forming a part of the weightlifting rack) and providing an exercise pad. The exercise pad includes a body with a first major surface, a second major surface parallel (and opposite) to the first major surface, and side surfaces that extend between the first major surface and the second major surface. A groove is formed in the first major surface of the body. The groove extends across the body in a longitudinal direction from a first one of the side surfaces to a second one of the side surfaces that is opposite to and parallel to the first one of the side surfaces. The groove is configured (e.g., with a keyhole-style cross-sectional shape) to receive and engage an elongate bar (e.g., the barbell). The method further includes coupling the exercise pad to the elongate cylindrical bar, supporting at least part of a human's weight with the exercise pad while the exercise pad is coupled to the elongate cylindrical bar, and the human performing an exercise (e.g., a hip thrust) while the human's weight is being at least partially supported on the exercise pad that is coupled to the elongate cylindrical bar.

In some implementations, one or more of the following advantages are present.

For example, in one implementation, an exercise pad is disclosed (with an approximately cuboid shape having a keyhole-shaped groove, as described herein) that may be, for example, 17.5 inches long, 10 inches wide, and 3 inches tall. The exercise pad may be designed to snap onto/couple to/engage a racked barbell by utilization of the keyhole-shaped groove on a surface of the pad that runs the entire length of the pad. By snapping the pivot pad onto a barbell, a user (e.g., human exerciser) can access much more exercise utility from their existing equipment (e.g., barbell plus rack). With the pivot pad in place on a barbell while racked (e.g., upon j-cups or j-hooks, which typically come with power racks and squat racks to hold a barbell at different heights), a user can press upon the pad to sandwich the barbell between the squat racks upright posts and the exercise pad, for example, to keep the barbell substantially in place. Once the barbell is in place and the pad is coupled to the barbell, the pad can move freely around the fixed barbell in a pivoting motion as a lever, using the barbell as a shaft or pinion and the centered keyhole cut out as a fulcrum point. This pivoting motion allows for a wide array of exercises to be performed upon it but most specifically, and most advantageously, the hip hinge or hip thrust movement.

The hip thrust is an exercise traditionally done against a flat utility bench where an exerciser would sit on the floor with their shoulder blades to mid back area pressed against the side of a bench and a barbell, weight or some other form of resistance resting across their hips or pelvis, with their feet flat on the ground and their knees up creating a V-shape between their thighs and torso. The goal of the hip thrust is to hinge back and thrust the weight on one's pelvis upward until the V-shape is straightened out to create a table like position where one's feet remain flat on the ground, one's back is resting on top of the corner of the bench, one's posterior is elevated off the ground, and one's legs form a substantially 90 degree angle.

Three main problems with a traditional hip thrust set up are height adjustability, back discomfort, and stability; all three of which are addressed by implementations of the exercise pad and its use, as disclosed herein.

More specifically, for example, though the height of a flat bench may be perfect for some people, the majority of people typically require a different set up height to perform a hip thrust properly. The industry suggested height is approximately the length of an exerciser's knee to the floor which varies greatly amongst users. Additionally, the corner of a bench typically provides little comfort when pressed upon and offers very little displacement of the weight across one's back leaving what is sometimes an enormous amount of weight being concentrated upon a small area of one's back that is in contact with the bench. Additionally, the danger of pressing upon the corner of a bench designed to only be stable when pressed straight down upon can be great. Sometimes, during the setup, a bench will tip over unexpectedly risking injury to the user.

When utilizing the exercise pad disclosed herein, along with a rack and barbell as described, an exerciser typically has numerous height options that the exerciser can choose from to ensure the perfect height for the exerciser during the exercise. This is true because power racks typically have numerous hole options at different heights, spaced out from the bottom few inches of the rack and extended all the way to the top of the rack in which one can place a J-cups (or J-hooks) to hold a barbell offering variable height options amongst the users.

Additionally, when using the exercise pad disclosed herein, especially in the manner disclosed herein to perform a hip thrust exercise, a user typically experiences much more comfort than with a bench from the setup and throughout the entire movement. This additional comfort is generated by the substantially larger surface area a user presses against while using the exercise pad compared to using the corner of a bench. This displaces the load over a larger area resulting in a more comfortable and safer experience.

Moreover, when it comes to stability the exercise pad disclosed herein is substantially safer than the flat utility bench alternative. While a flat utility bench is prone to tipping, the exercise pad disclosed herein is configured to move with the user when pressed upon creating a uniform support on your back from start to finish while utilizing a power rack which is much more stable than a bench.

In some implementations, the exercise pad represents a removable device that snaps onto a barbell to convert the barbell and a supporting rack into a variable height hip thrust station. Moreover, in some implementations, the exercise pad represents a soft foam device with a rigid core that snaps onto a barbell to offer a flat pivoting surface.

Other features and advantages will be apparent from the description and drawings, and from the claims.

BRIEF DESCRIPTION OF THE DRAWINGS

Like reference characters refer to like elements.

DETAILED DESCRIPTION

Figure 1:
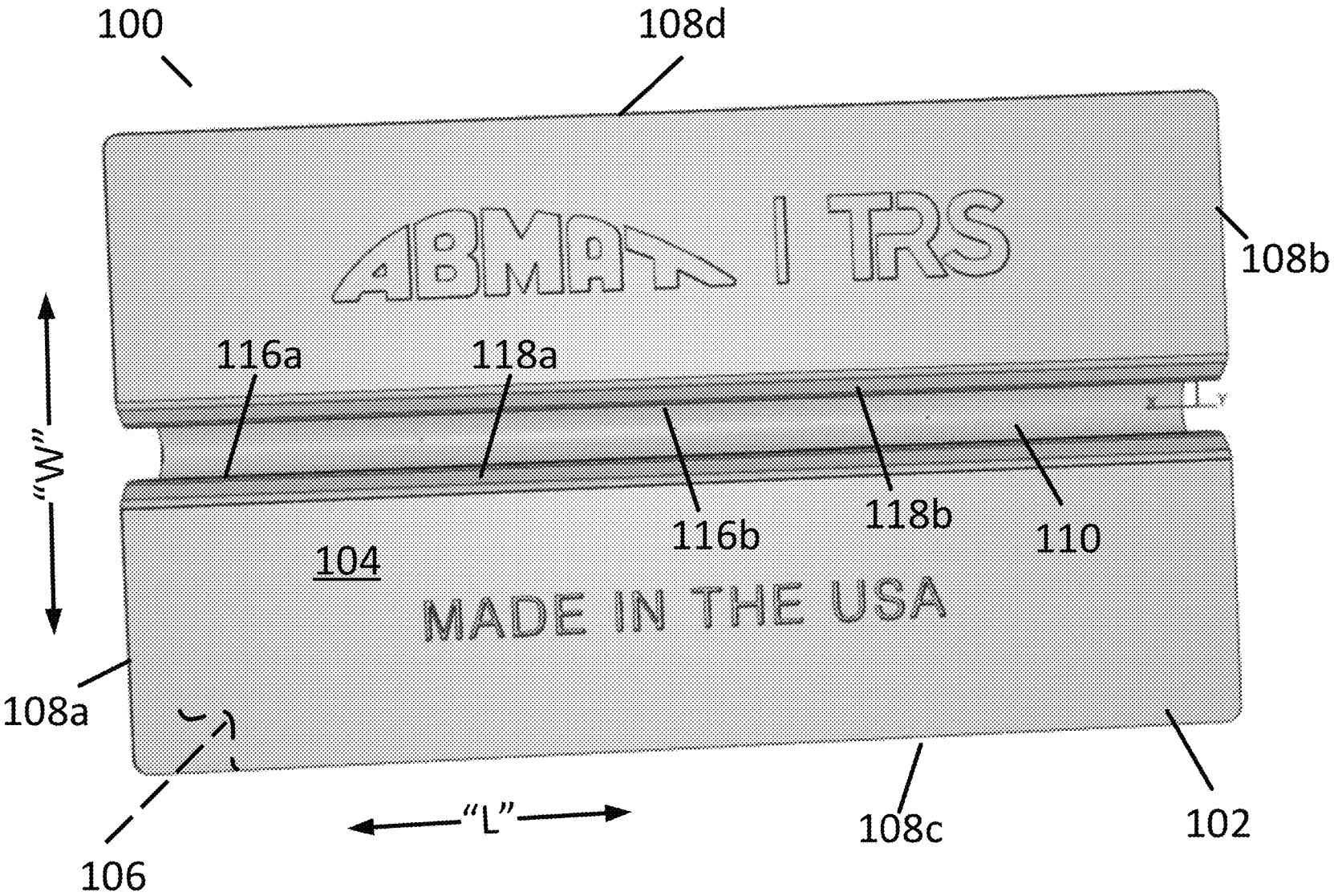
FIG. 1 is a bottom view of an exemplary implementation of an exercise pad that is configured to be coupled to a horizontally-disposed bar, such as a barbell resting on a weightlifting rack, and then used to facilitate the performance of hip thrusts or other exercises.
Figure 2:
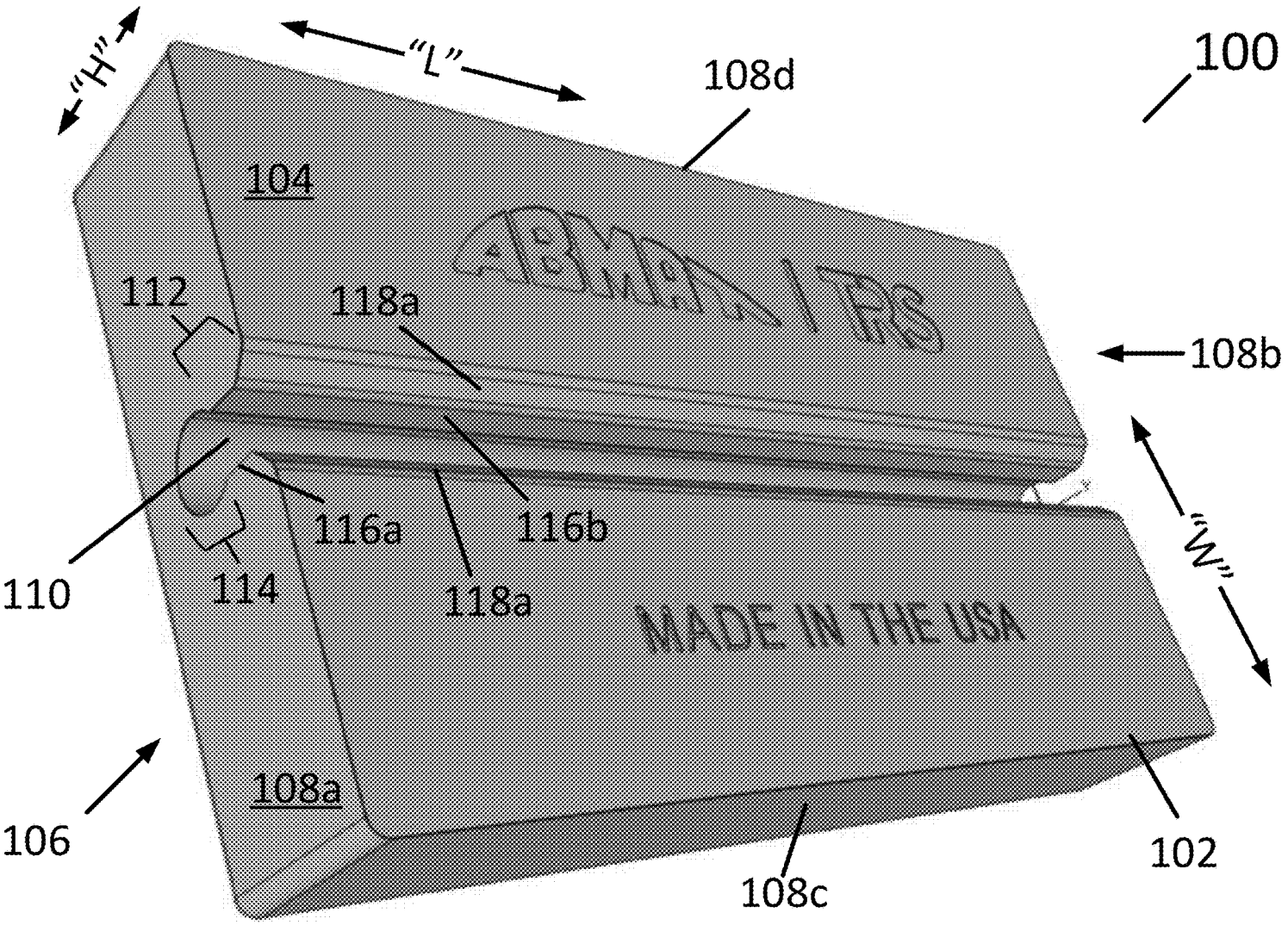
FIG. 2 is a perspective side and bottom view of the exercise pad in FIG. 1.
Figure 3:
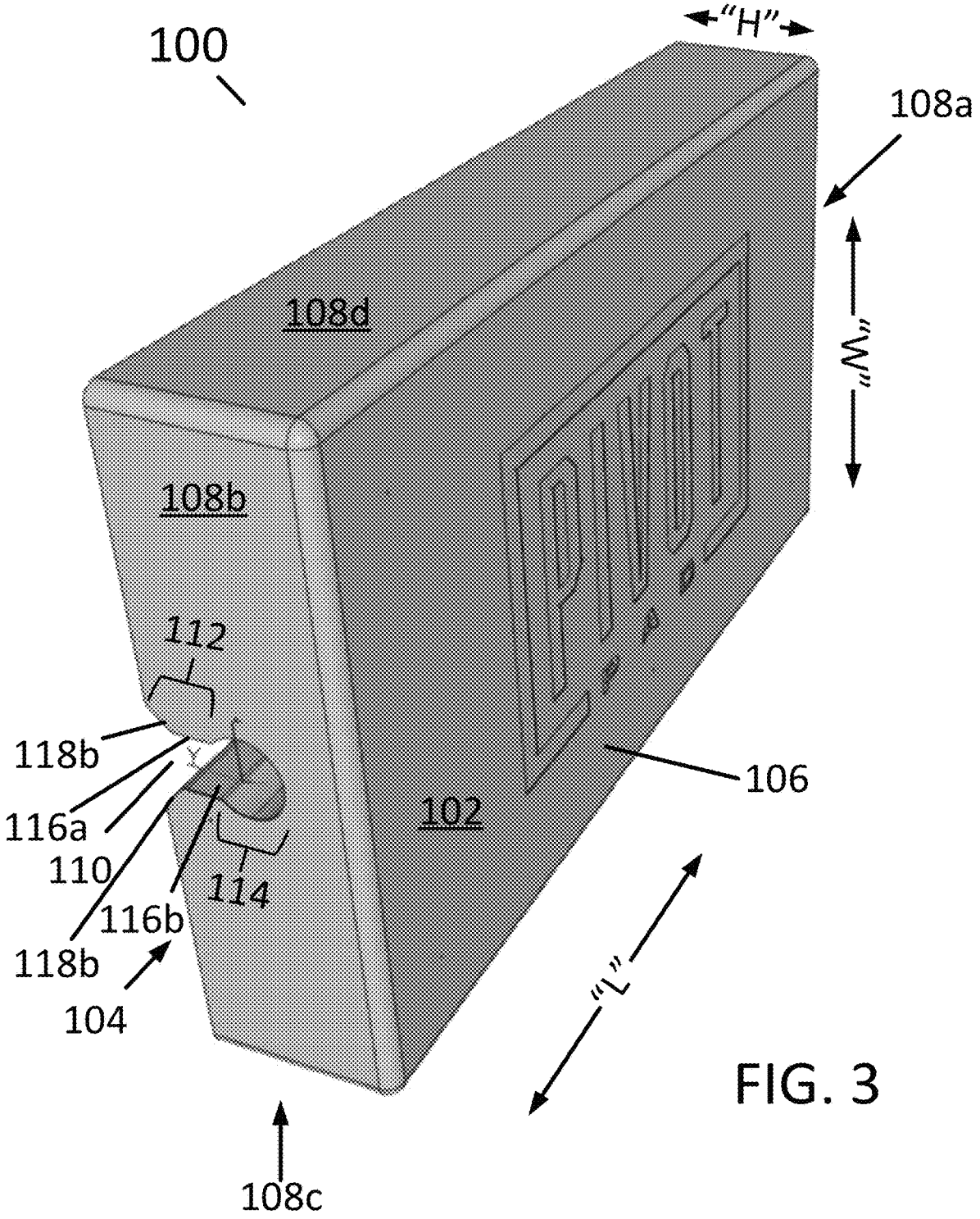
FIG. 3 is a perspective top and side view of the exercise pad in FIG. 1.
Figure 4:
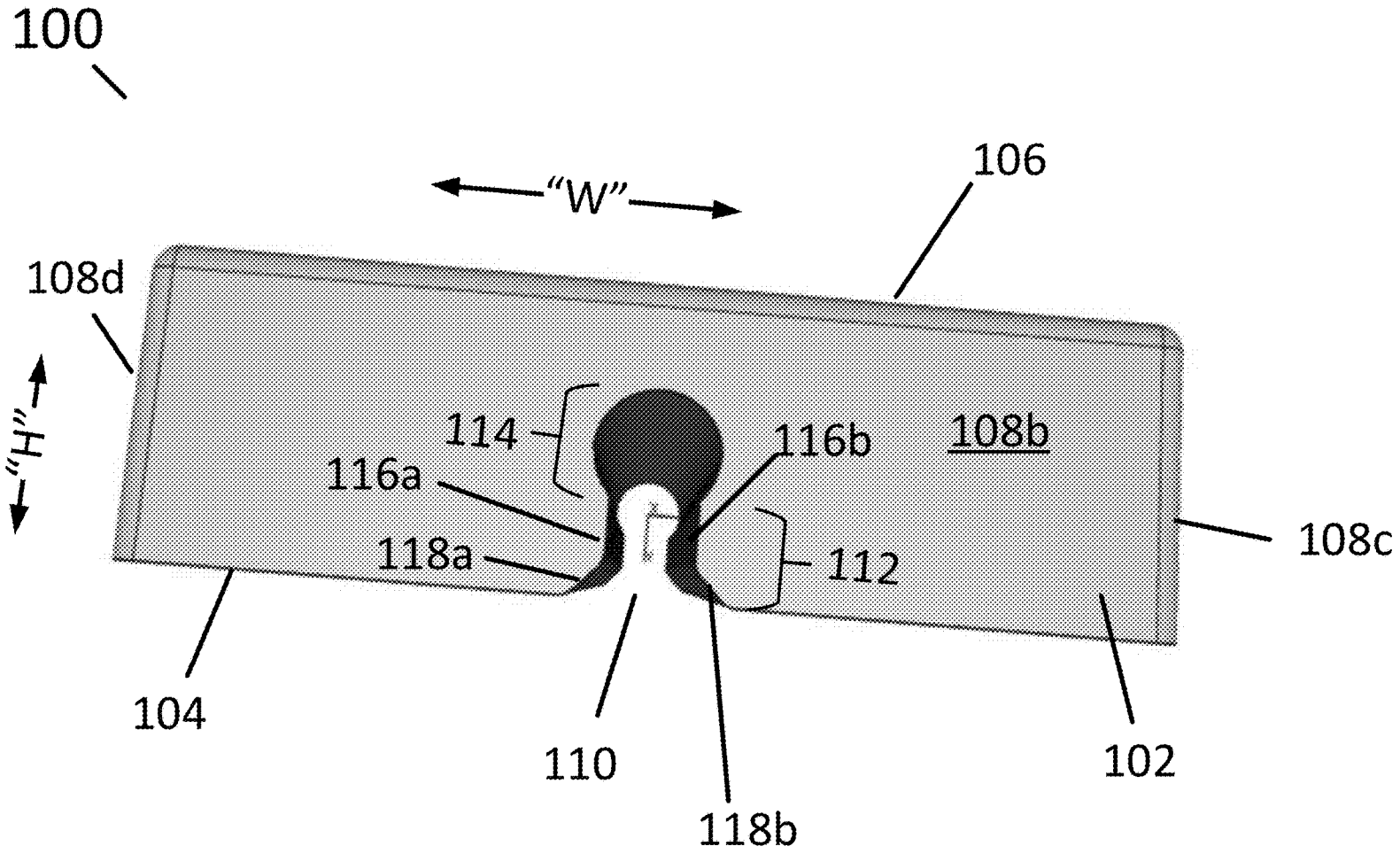
FIG. 4 is a side view of the exercise pad in FIG. 1.
Figure 5:
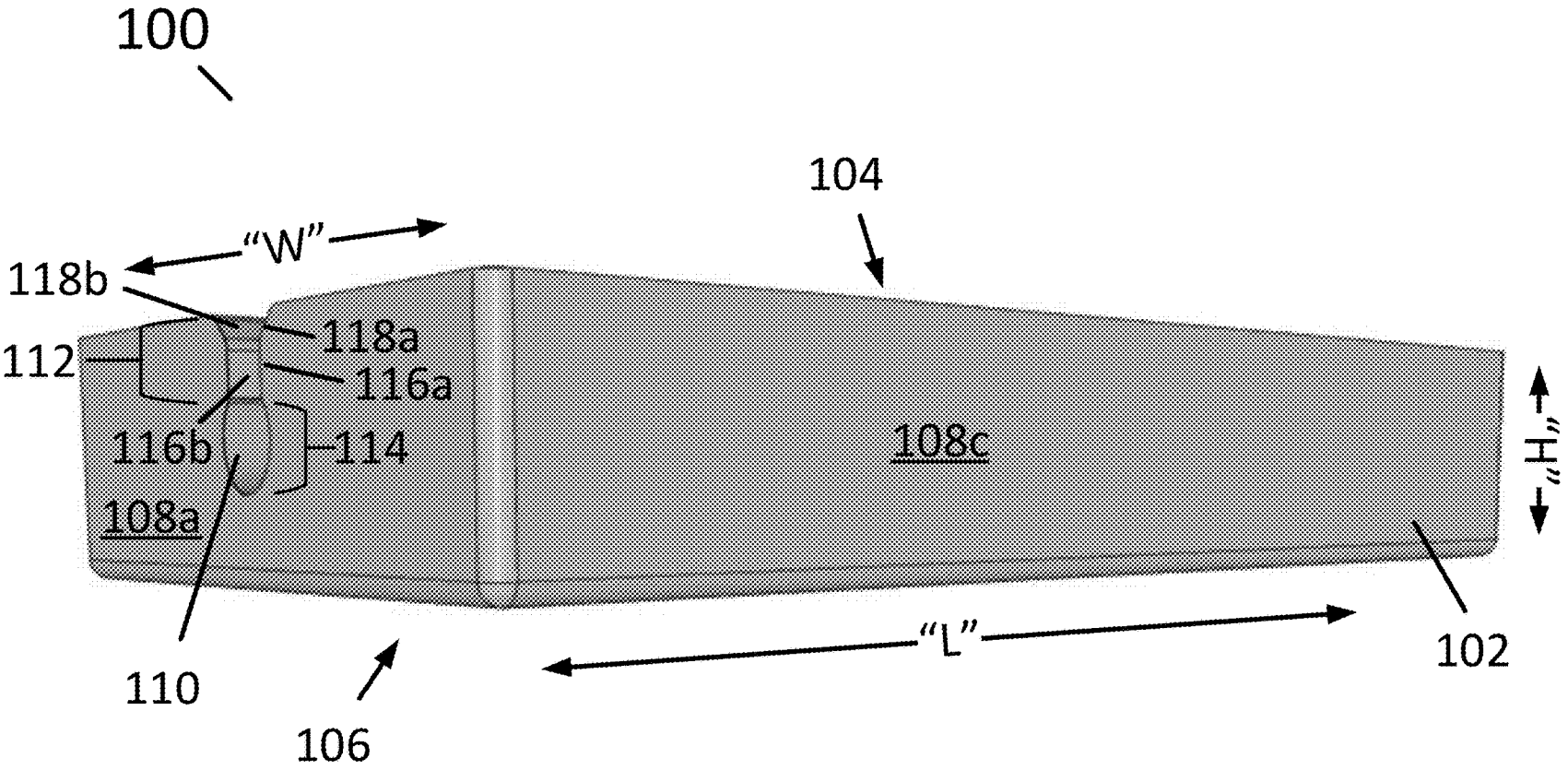
FIG. 5 is a perspective side view of the exercise pad in FIG. 1.
Figure 6:
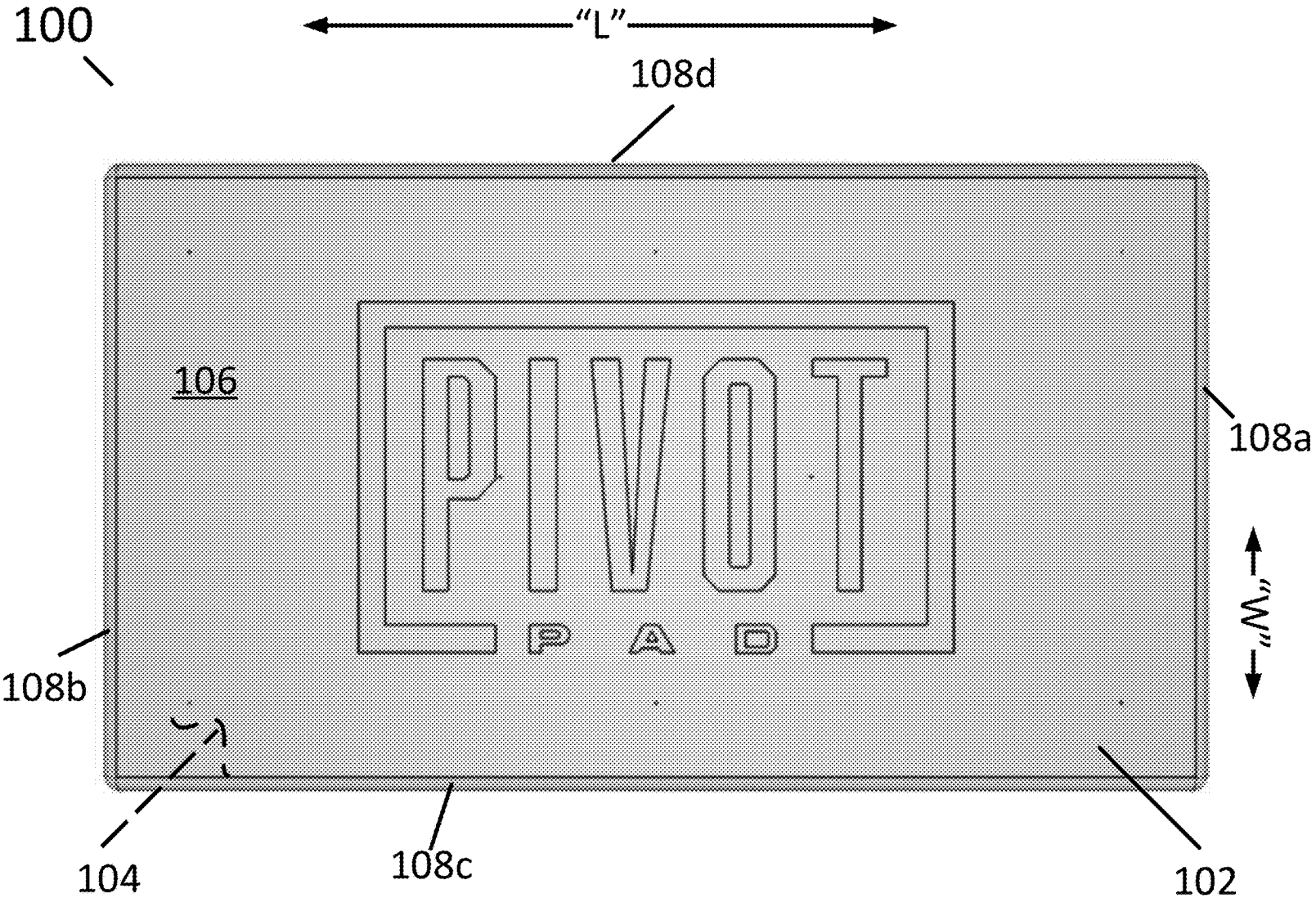
FIG. 6 is a top view of the exercise pad in FIG. 1.
Figure 7:
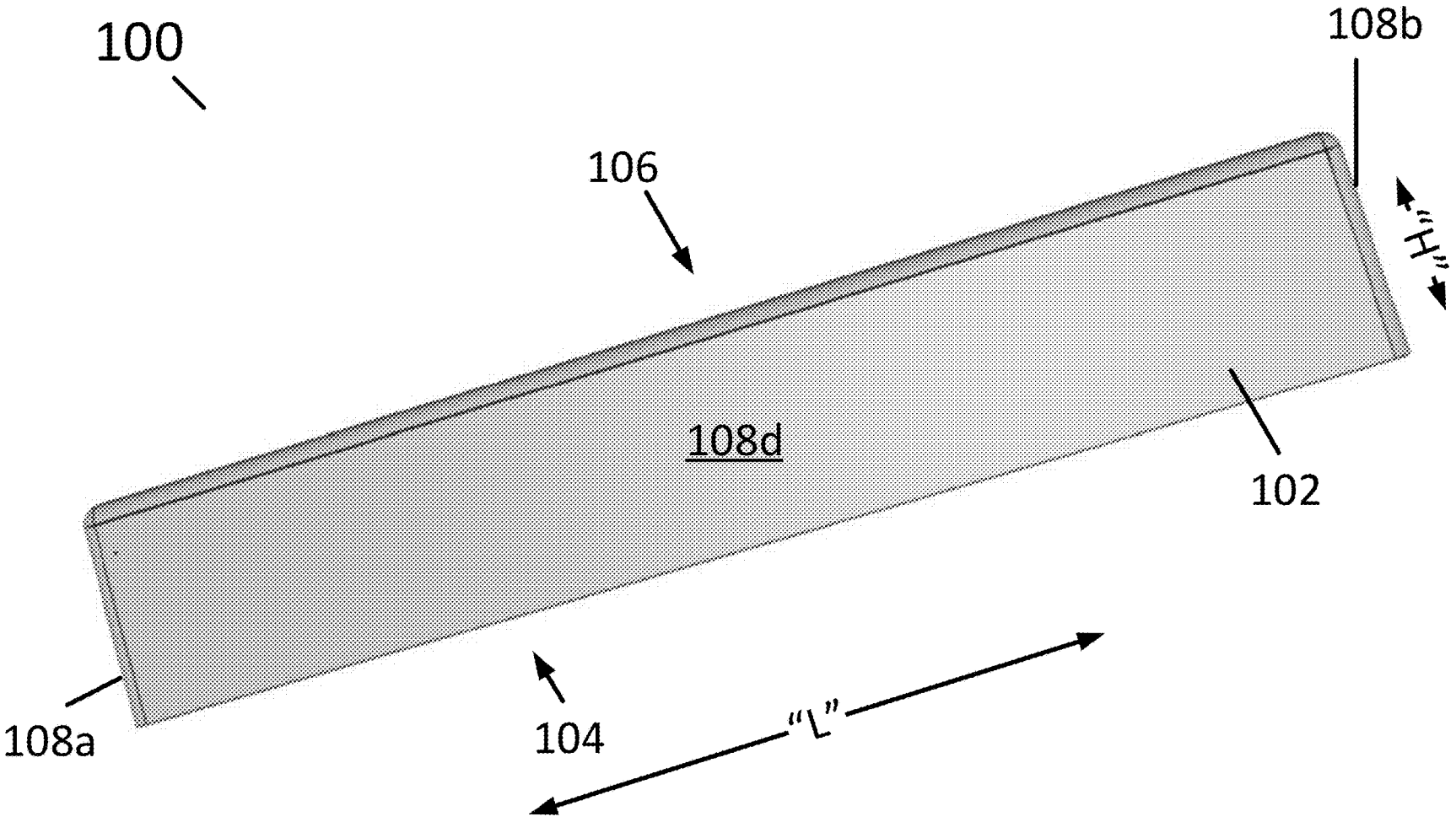
FIG. 7 is a side view of the exercise pad in FIG. 1.

FIGS. 1-7 are views of an exemplary implementation of an exercise pad 100 that is configured to be coupled to a horizontally-disposed bar, such as a barbell resting on a weightlifting rack, and then used to facilitate the performance of hip thrusts or other exercises.

The illustrated exercise pad 100 has a body 102 with three major dimensions—a length (in the "L" direction), a width (in the "W" direction), and a height (in the "H" direction). In the illustrated implementation, the length is the largest major dimension, the width is the second largest major dimension, and the height is the smallest major dimension. The body 102 has a first major surface 104, a second major surface 106 that is parallel to the first major surface 104, and side surfaces 108*a*, 108*b*, 108*c*, 108*d* that extend between the first major surface 104 and the second major surface 106. Every side surface 108*a*, 108*b*, 108*c*, 108*d* is perpendicular to the first major surface 104, perpendicular to the second major surface 106, and perpendicular to the two side surfaces that are adjacent to that side surface.

A groove 110 formed in the first major surface 104 of the body 102. The groove 110 extends across the body 102 in the longitudinal direction ("L") between the first side surface 108*a* and the second side surface 108*b* and essentially bisects the first major surface 104. More specially, the groove 110 in the illustrated implementation is centered on the first major surface 104 equidistant between the third side surface 108*c* and the fourth side surface 108*d* along its entire length. The upper edges of the third side surface 108*c* and the fourth side surface 108*d*, in the illustrated implementation, are parallel to the upper edges of the groove 110.

The depth of the groove 110 is less than the height (in the "H" direction) of the body 102. The groove 110 is straight and has a uniform cross-sectional shape across its entire length. The uniform cross-sectional shape of the groove 110 makes the groove 110 suitable to receive and engage an elongate bar, such as a weightlifting barbell. In this regard, the uniform cross-sectional shape of the groove 110 includes an upper portion 112 that defines an entrance at the top of the groove 110 (e.g., closest to the first major surface 104), through which the elongate bar can be pushed (e.g., by a weightlifter pressing the exercise pad 100 onto the bar). The uniform cross-sectional shape of the groove 110 also has a lower portion 114, beneath the upper portion, configured to receive and contain the bar once the bar is pushed through the entrance and into engagement with the groove.

In a typical implementation, the upper portion 112 of the groove 110 has a width that is slightly smaller than the diameter of the bar. In such implementations, at least the upper portion 112 of the groove 110 has some degree of elasticity, such that when the groove 110 is aligned with the bar and the exercise pad 100 is pushed onto the bar, the upper portion 112 of the groove 110 flexes to temporarily widen and allow the bar to enter into the lower portion 114 of the groove 110 and then regains its original configuration so that the upper portion 112 of the groove 110 regains its original configuration having a width that is smaller than the bar's diameter.

The actual difference between bar diameter and the width of the upper portion 112 of the groove 110 can vary, of course. However, in a typical implementation, the section of the bar that pushes through the upper portion 112 of the groove 110 to engage the exercise pad 100 has a diameter that is at least 0.1 inches larger than the smallest width in the upper portion 112 of the groove 110 when the upper portion 112 of the groove 110 is in a relaxed (i.e., unstressed) state. In such an example, the upper portion 112 of the groove 110 widens to allow the bar to pass into the lower portion 114 of the groove 110 in response to an applied force urging the exercise pad 100 and the bar into engagement with one another. Once the bar passes the upper portion 112 of the groove 110 and enters the lower portion 114 of the groove 110, the upper portion 112 of the groove 110 tends to return, either completely or partially, to its original configuration, which tends to maintain the bar in a state of physical engagement with the exercise pad 100.

In a typical implementation, the lower portion 114 of the groove 110 is large enough to receive and hold the bar after the bar passes through the upper portion 112 of the groove 110. In some implementations, the lower portion 114 of the groove 110 holds the bar snugly. In some of those implementations, once the bar is inside the lower portion 114 of the groove 110, the entire inner surface of the lower portion 114 of the groove is in (and maintains) direct physical contact with the bar until the exercise pad 100 and the bar are pulled apart from one another. In some implementations, the inner diameter (or width) of the lower portion 114 of the groove 110 is slightly larger than the bar. In those implementations, for example, the bar may be allowed to freely rotate, about a longitudinal axis, within the lower portion 114 of the groove 110. In various implementations, the inner diameter (or width) of the lower portion 114 of the groove 110 has an inner diameter (or width) that is at least as large as the outer diameter of the bar and, in an exemplary implementation, at least 0.1 inches larger than the outer diameter of the bar.

The specific cross-sectional shape of the groove 110 in the illustrated implementation is a keyhole shape. More specifically, in the illustrated example, the upper portion (entrance) 112 of the groove 110 includes a pair of surfaces that extend from the first major surface 104 down into the body 102, and the lower portion 114 of the groove 110 is defined by a curved surface that extends between the bottom ends of the pair of surfaces. The pair of surfaces that define the upper portion 112 of the keyhole shaped groove 110 include a first section that includes a pair of surfaces 116*a*, 116*b* that are parallel to one another (when the groove 110 is in a resting, or unstressed state), and a second section above the first section that forms a bevel, curve or otherwise contoured shape 118*a*, 118*b* that flares outwardly from the tops of the pair of surfaces and extends between the first section and the first major surface 104 of the exercise pad 100.

In the illustrated implementation, the curved surface that defines the lower portion 114 of the groove 110 follows a circular path. As discussed herein, the circular path has a diameter that is larger than the smallest distance between the pair of parallel surfaces 116*a*, 116*b* in the upper portion 112 of the groove 110.

As discussed above, the major surfaces 104, 106, and 108*a*-108*d* of the exercise pad can vary in appearance. However, in the illustrated implementation, the first major surface 104 includes two portions, a first of which has written on it "Abmat|TRS," and a second of which has written on it, "Made in the USA." Each of these markings is substantially centered on the portion of the first major surface 104 where it appears. These markings may be made in a variety of different ways including, for example, with ink, stickers, grooves, or raised material on the first major surface 104. The first portion of the first major surface 104 is surrounded by three outer edges of the first major surface 104 and a first upper edge of the groove 110. The second portion of the first major surface 104 is surrounded by three other outer edges of the first major surface 104 and a second upper edge of the groove 110. Each portion of the first major surface 104 is rectangular, planar, and substantially uniform between the associated outer edges of the first major surface 104 and the upper edges of the groove 110. Unless otherwise indicated, the phrase "planar, and substantially uniform," as used herein, should be understood to be flat (which may include a smooth, or rough, textured finish) and unchanging in form or character except for any applied marks (e.g., "Abmat|TRS" and "Made in the USA") and/or other ornamentation provided on the surfaces. Of course, in some implementations, there may be no such applied marks and, in some implementations, the applied marks may be different from those shown in the figure. Each outer edge of the first major surface 104 is at a 90 degree bend (+/−2 degrees) between the first major surface 104 and a corresponding one of the side surfaces 108*a*-108*d* of the exercise pad 100. Moreover, the outer corners of the first major surface 104 are rounded. It should be noted that ABMAT® is a registered trademarks of Custom Product Innovations, Inc., applicant of the current patent application, and TRS™ is a trademark of The Ready State Inc. Also, of course, the "Made in the USA" marking indicates just that—that the product was made in the United States. If that were not the case, then the marking may be modified to indicate place of manufacturing or omitted entirely.

The second major surface 106 in the illustrated implementation has four outer edges that surround a rectangular surface that is planar and substantially uniform between all four outer edges. The planar and substantially uniform second major surface 105 has written on it a mark that includes the phrase "Pivot Pad," which is substantially centered on the second major surface 106. This marking may be made in a variety of different ways including, for example, with ink, stickers, grooves, or raised material on the second major surface 104. Each outer edge of the second major surface 106 defines a rounded curve between the second major surface 104 and a corresponding one of the side surfaces 108*a*-108*d* of the exercise pad 100. The outer corners of the second major surface 104 are rounded as well.

The first side surface 108*a* includes four outer edges of the exercise pad 100 and an edge of the groove 110, which interrupts one of the outer edges. The four outer edges of the exercise pad 100 and the edge of the groove 110, surround a surface that is planar and substantially uniform between the four outer edges of the exercise pad 100 and the edge of the groove 110 on the first side surface 108*a*. The outer edge of the first side surface 108*a* that is interrupted by the groove 110 is at a 90 degree bend (+/−2 degrees) between the first side surface 108*a* and the first major surface 104. The edge of the groove 110 on the first side surface 108*a* forms a 90 degree bend (+/−2 degrees) between the first side surface 108*a* and corresponding inner surfaces of the groove 110. The other outer edges of the first side surface 108*a* are rounded.

The second side surface 108*b*, which is opposite and parallel to the first side surface 108*a*, includes four outer edges of the exercise pad 100 and an edge of the groove 110, which interrupts one of the outer edges. The four outer edges of the exercise pad 100 and the edge of the groove 110 surround a surface that is planar and substantially uniform between the four outer edges of the exercise pad 100 and the edge of the groove 110 on the second side surface 108*b*. The outer edge of the second side surface 108*b* that is interrupted by the groove 110 is at a 90 degree bend (+/−2 degrees) between the second side surface 108*b* and the first major surface 104. The edge of the groove 110 on the second side surface 108*b* forms a 90 degree bend (+/−2 degrees) between the second side surface 108*b* and corresponding inner surfaces of the groove 110. The other outer edges of the second side surface 108*b* are rounded.

The third side surface 108*c* has four outer edges that surround a rectangular surface that is planar and substantially uniform between all of the four outer edges of the third side surface 108*c*. The outer edge of the third side surface 108*c* that borders the first major surface 104 is at a 90 degree bend (+/−2 degrees) between the third side surface 108*c* and the first major surface 104. The other outer edges of the third side surface 108*c* are rounded.

The fourth side surface 108*d* has four outer edges that surround a rectangular surface that is planar and substantially uniform between all of the four outer edges of the fourth side surface 108*d*. The outer edge of the fourth side surface 108*d* that borders the first major surface 104 is at a 90 degree bend (+/−2 degrees) between the fourth side surface 108*d* and the first major surface 104. The other outer edges of the fourth side surface 108*d* are rounded.

The body 102 of the exercise pad 100 can be made of any number of possible materials or combinations of materials. For example, in some implementations, in some implementations, the body 102 is made from a foam material. The foam, in some instances, may be a polyurethane foam such as a molded dense polyurethane foam (in an exemplary implementation, the density is in the range of 35-40 shore A durometer with a part weight between 5-5.4 pounds), or a dense crosslink polyethylene foam (e.g., 9 #crosslink polyethylene). In other implementations, the body 102 is made from rubber, plastic, silicone, or other suitable material that is able to provide support and preferably comfort to an exerciser attempting to perform hip thrusts, or other exercises, while at least partially supported by the exercise pad 100.

In some implementations, the body 102 includes an internal rigid core. The internal rigid core, for example, may be embedded inside, and completely surrounded by, the foam (or other) material of the body 102.

Figure 8:
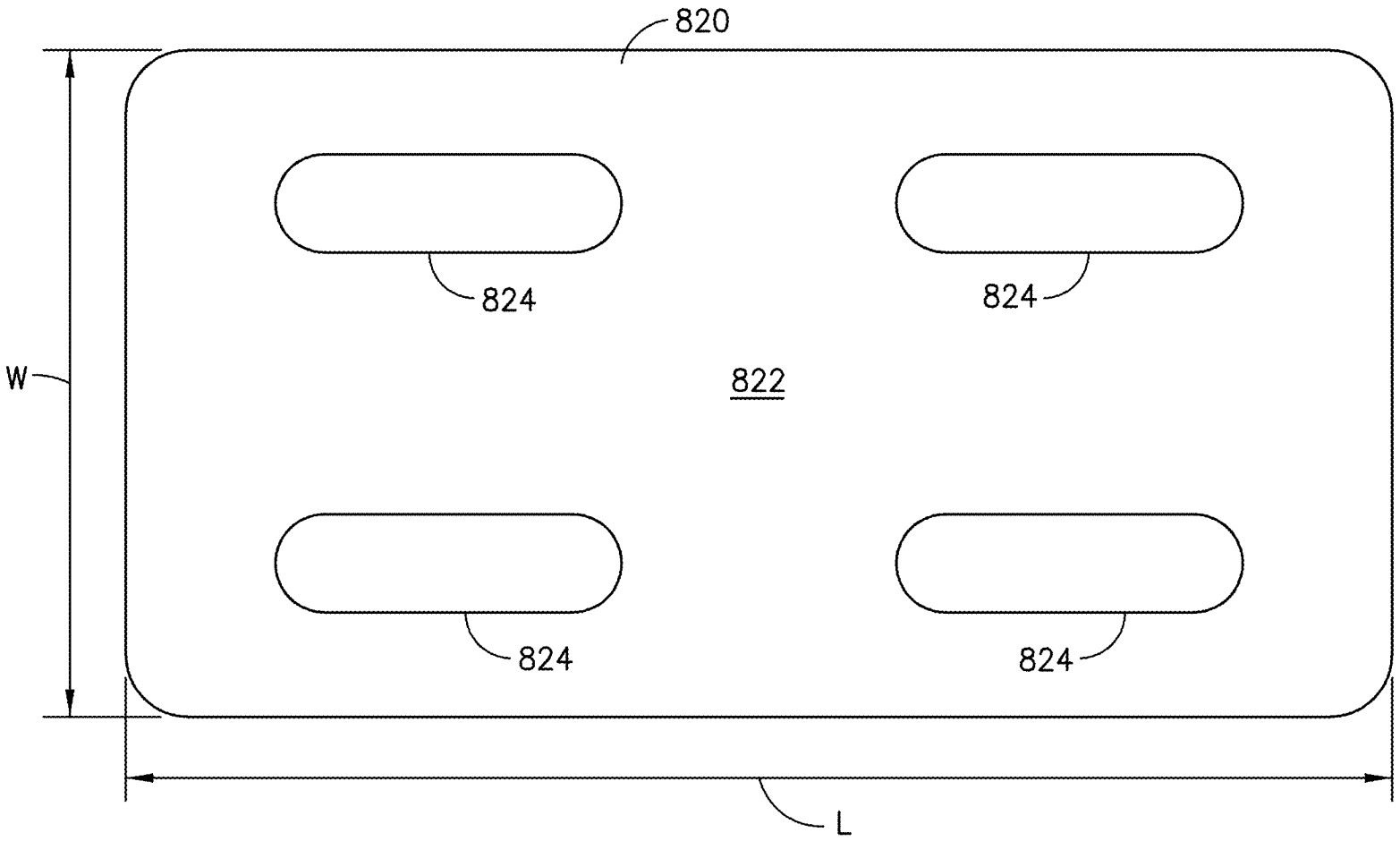
FIG. 8 is a top view of an exemplary rigid core of an exercise pad.

FIG. 8 shows a top view of an exemplary rigid core 820. The illustrated rigid core 802 is flat with a flat upper surface 822 (visible in FIG. 8) and a flat lower surface (not visible in FIG. 8), opposite and parallel to the flat upper surface 822. The flat upper surface 822 (and flat lower surface) has four straight outer edges and four rounded corners connecting the outer edges. Thus, the flat upper surface 822 (and the flat lower surface) has a rounded rectangular shape.

The illustrated rigid core 820 has a length (in the "L" direction), a width (in the "W" direction), and a thickness (that extends into the image in FIG. 8). The length (in the "L" direction) of the illustrated rigid core 820 is greater than the width (in the "W" direction) of the illustrated rigid core 820. The thickness (not visible in FIG. 8 but see FIG. 9) of the rigid core 820 is significantly less than both the length and the width.

The illustrated rigid core 820 has internal surfaces that define four apertures 824, each of which extends completely through the rigid core 820 from the upper surface 822 to the lower surface, in the thickness direction (i.e., into the image in FIG. 8). The apertures 824 in the illustrated rigid core 820 are arranged in a two by two array and each aperture 824 is the same size and shape as the other apertures in the illustrated rigid core 802. Specifically, each aperture 802 in the illustrated rigid core is stadium (or pill)-shaped, having semicircular curve portions at opposite ends of the aperture, and a pair of straight parallel edges extending between the semicircular ends. The straight parallel edges of each aperture 802 are parallel to one another but also parallel to the straight outer edges that extend along the length of the upper surface 822 of the illustrated rigid core 820.

One purpose of the apertures 824 in the rigid core 820 is to allow the foam that is formed around the rigid core 820 to flow through the rigid core 820. This helps the body 102 of the exercise pad 100 to fill out properly without substantial (or in some instances any) voids.

Figure 9:
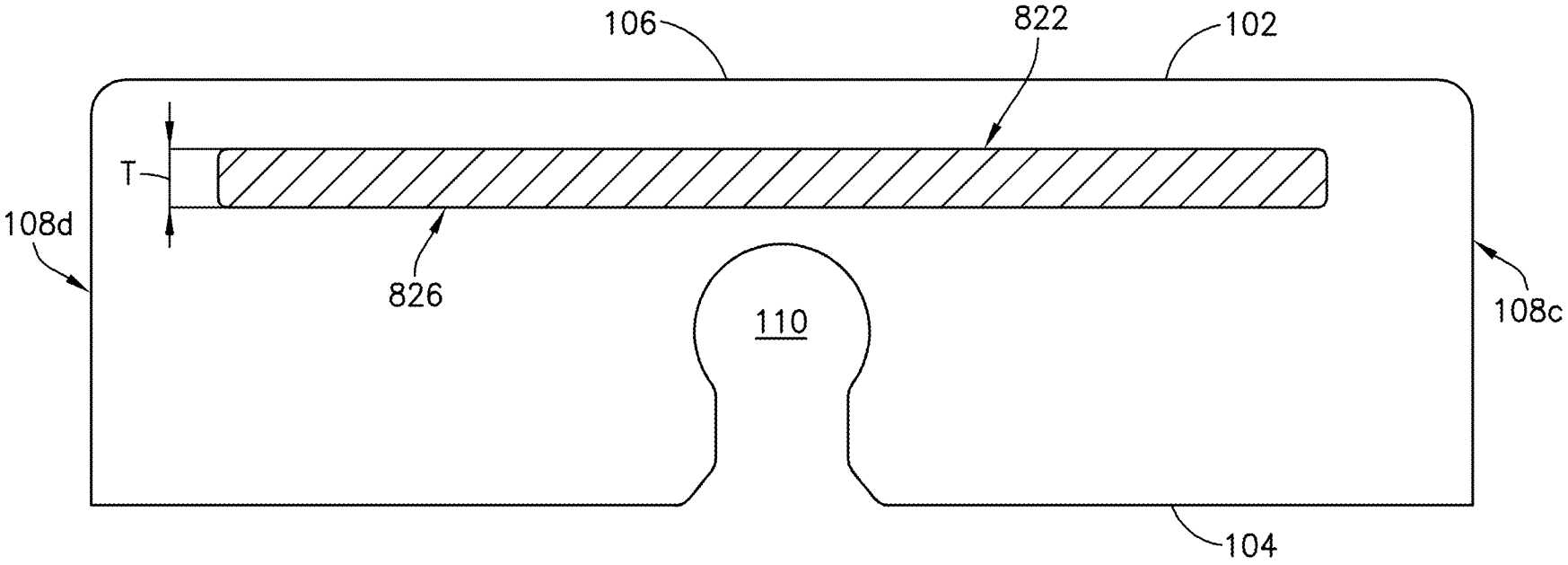
FIG. 9 is a cross-sectional view of an exercise pad.

FIG. 9 is a cross-sectional view of an exemplary exercise pad (e.g., 100) showing the rigid core 820 of FIG. 8 inside foam to form the body 102 of the exercise pad. According to the illustrated implementation, the rigid core 820 is positioned inside the foam material and configured so that its flat upper surface 822 and flat lower surface 826 are parallel to the first major surface 104 and the second major surface 106. A portion of the rigid core 820 is between the groove 110 the second major surface 106. Moreover, the rigid core 820 is centered between the third side surface 108*c* and the fourth side surface 108*d* of the body 102 of the exercise pad. As mentioned above, the rigid core 820 has a thickness, which is shown (and marked "T") in the illustrated figure.

The length, width, and thickness of the rigid core 820 can, of course, vary. Typically, however, the rigid core is sized so that it can be completely contained within (and surrounded by) the foam material of the body 102. In various implementations, the length ("L") of the rigid core 820 can be between 12 inches and 16 inches, the width ("W") of the rigid core 820 can be between 6.5 inches and 8.5 inches, and the thickness ("T") of the rigid core 820 can be between 0.25 inches and 0.5 inches. In one specific implementation, the length ("L") of the rigid core 820 is 14.5 inches, the width ("W") of the rigid core 820 is 7.5 inches, and the thickness ("T") of the rigid core 820 is ⅜ of an inch. Of course, these dimensions (and/or dimensional ranges) can be different, especially if the size of the exercise pad is larger or smaller.

Figure 10:
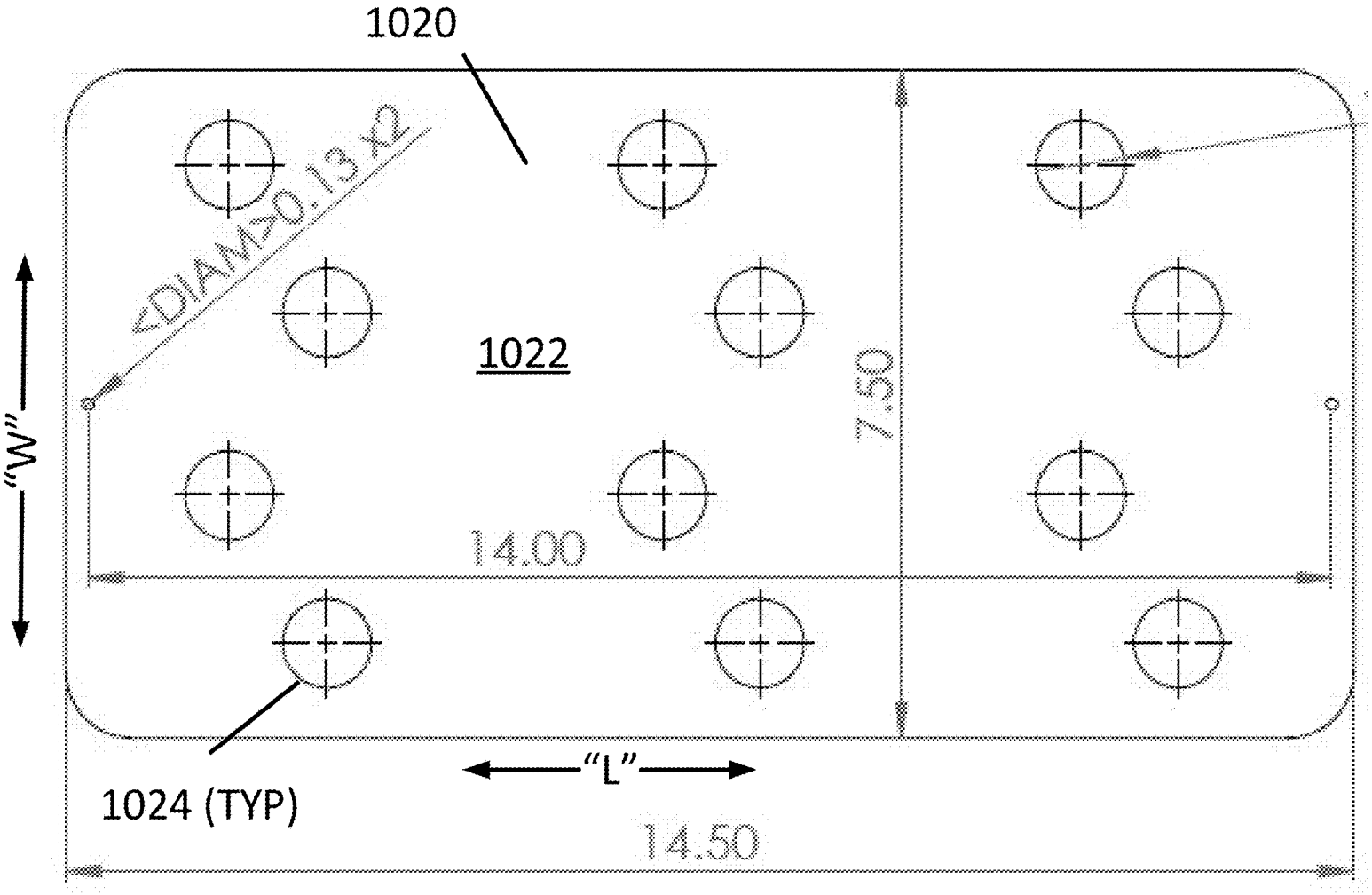
FIG. 10 is a top view of an alternative exemplary rigid core of an exercise pad.

FIG. 10 is a top schematic view of an alternative rigid core 1020.

The illustrated rigid core 1020 is similar in some ways to rigid core 820. Rigid core 1020 is flat with a flat upper surface 1022 (visible in FIG. 10) and a flat lower surface (not visible in FIG. 10), opposite and parallel to the flat upper surface 1022. The flat upper surface 1022 (and flat lower surface) has four straight outer edges and four rounded corners connecting the outer edges. Thus, the flat upper surface 1022 (and the flat lower surface) has a rounded rectangular shape.

The illustrated rigid core 1020 has a length (in the "L" direction), a width (in the "W" direction), and a thickness (that extends into the image in FIG. 10). The length (in the "L" direction) of the illustrated rigid core 1020 is greater than the width (in the "W" direction) of the illustrated rigid core 1020. The thickness (not visible in FIG. 10) of the rigid core 1020 is significantly less than both the length and the width.

The illustrated rigid core 1020 has internal surfaces that define twelve apertures 1024, each of which extends completely through the rigid core 1020 from the upper surface 1022 to the lower surface, in the thickness direction (i.e., into the image in FIG. 10). The apertures 1024 in the illustrated rigid core 1020 are arranged in a three columns, each column containing four staggered apertures 1024. Each aperture 1024 in the illustrated implementation is the same size and shape (circular/cylindrical) as the other apertures in the illustrated rigid core 802.

As with the apertures 824 in FIG. 8, one purpose of the apertures 1024 in the rigid core 1020 is to allow the foam that is formed around the rigid core 1020 to flow, during manufacturing, through the rigid core 1020. This helps the body 102 of the exercise pad 100 fill out properly without substantial (or in some instances any) voids.

Figure 11:
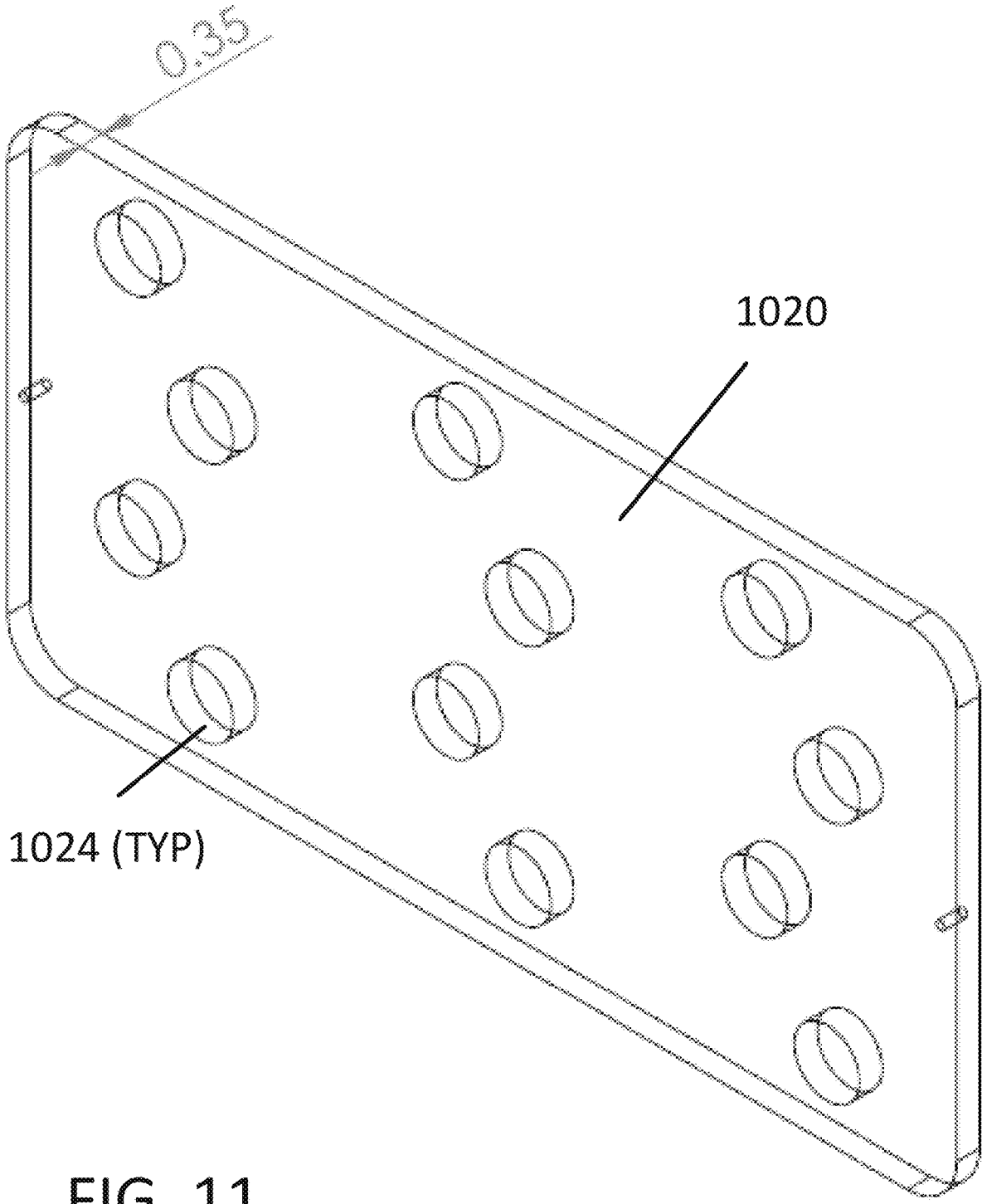
FIG. 11 is a perspective view of the alternative exemplary rigid core in FIG. 10.

FIG. 11 is a perspective view of the rigid core 1020 of FIG. 10. The illustrated rigid core 1020 the rigid core 820 has a thickness, which is shown (and marked as 0.35 inches) in the illustrated figure.

The rigid core 1020 of FIGS. 10 and 11 may be positioned within the body 102 of exercise pad 100 in much the same way as the rigid core 820 of FIG. 8. Various exemplary dimensions are provided in FIGS. 10 and 11. Each respective one of these dimensions can vary (e.g., +/−5%, +/−10%, etc.). In various implementations, the rigid core (e.g., 820 or 1020) can be made from any number of possible materials or combinations of materials including, for example, plastic, metal, wood, fiberglass, other rigid composites, and or combinations thereof.

Although the body 102, and rigid core (if present) of the exercise pad 100 can be made from any number of materials or combinations of materials, in a typical implementation, the body material, and the overall exercise pad 100, strikes a balance between rigidity to support the exerciser and softness for comfort. The body material also preferably has elasticity that allows the entrance portion of the groove to temporarily wide—to allow a barbell, which is larger in diameter than the opening in the entrance portion of the groove, to pass through the entrance portion of the groove and enter the lower portion of the groove—and then return to its previous configuration.

Figure 12A:
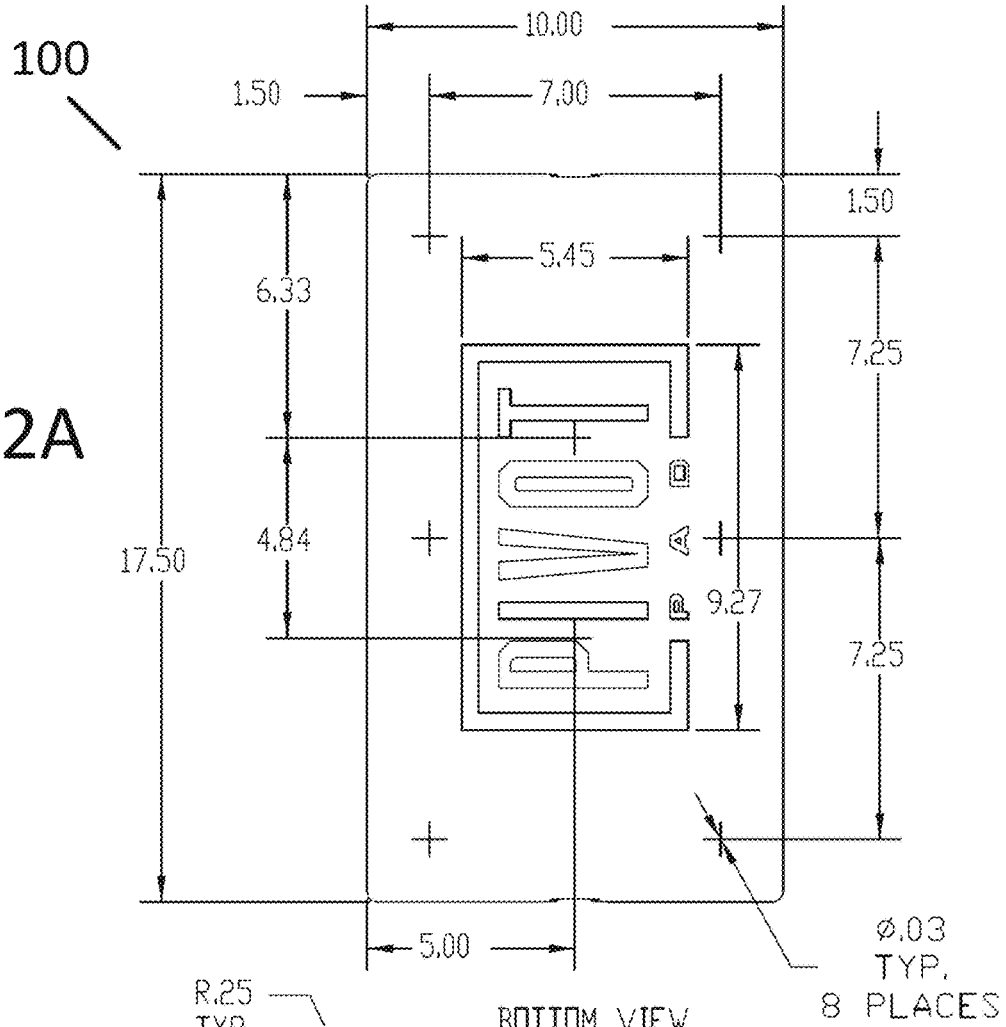
FIGS. 12A-12C are views of an exemplary implementation of the exercise pad in FIG. 1, showing various dimensions, particular only to the illustrated implementation.
Figure 12B:
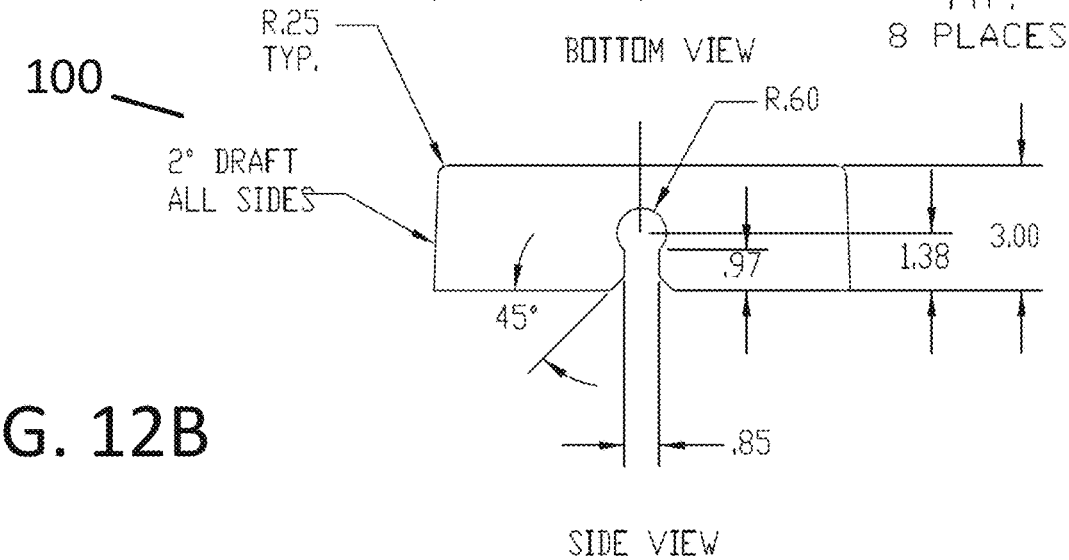
Figure 12C:
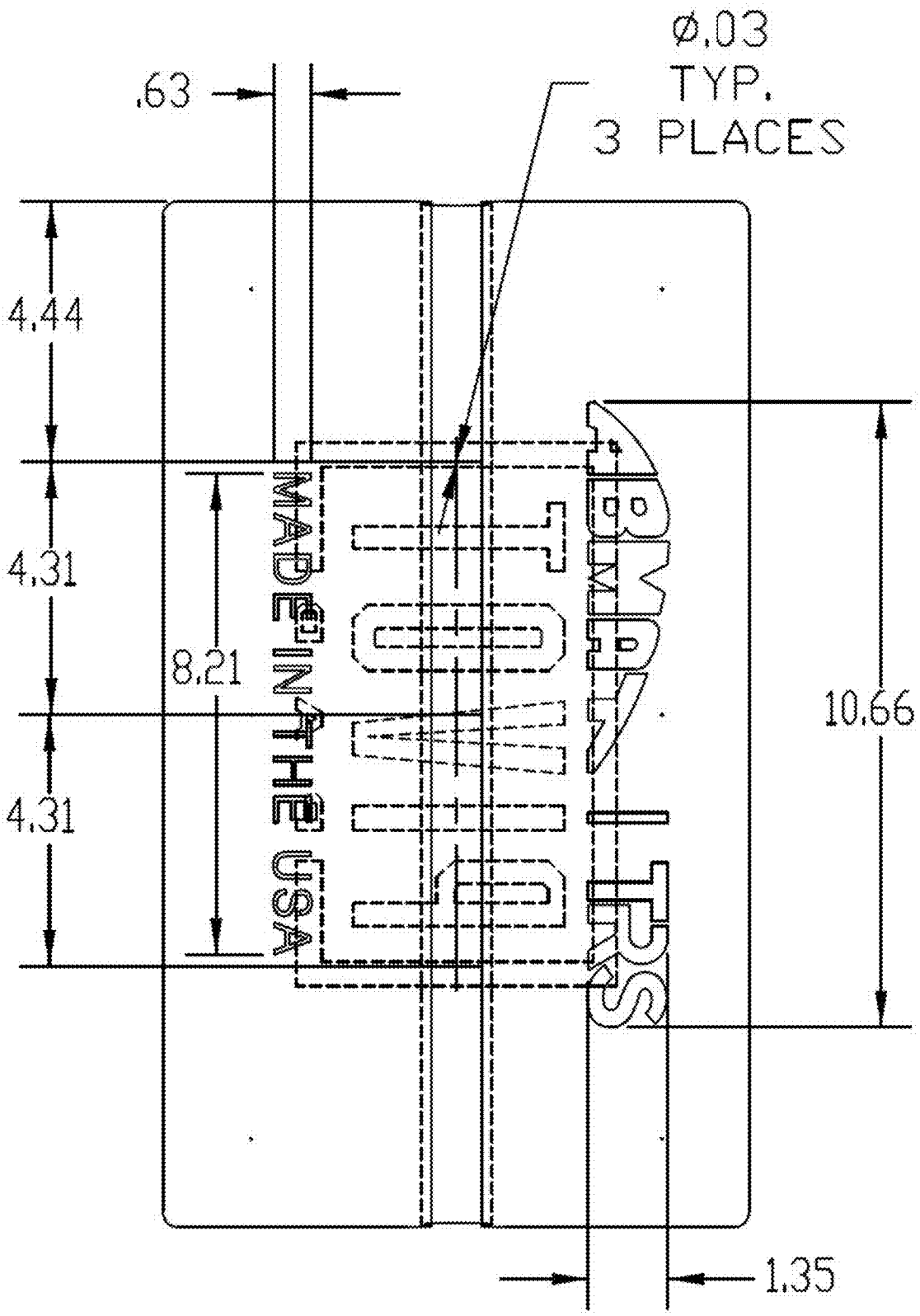

FIGS. 12A-12C are views showing an exemplary implementation of the exercise pad 100 from FIG. 1. These figures show one example of specific dimensions that apply to an exemplary implementation.

Figure 13:
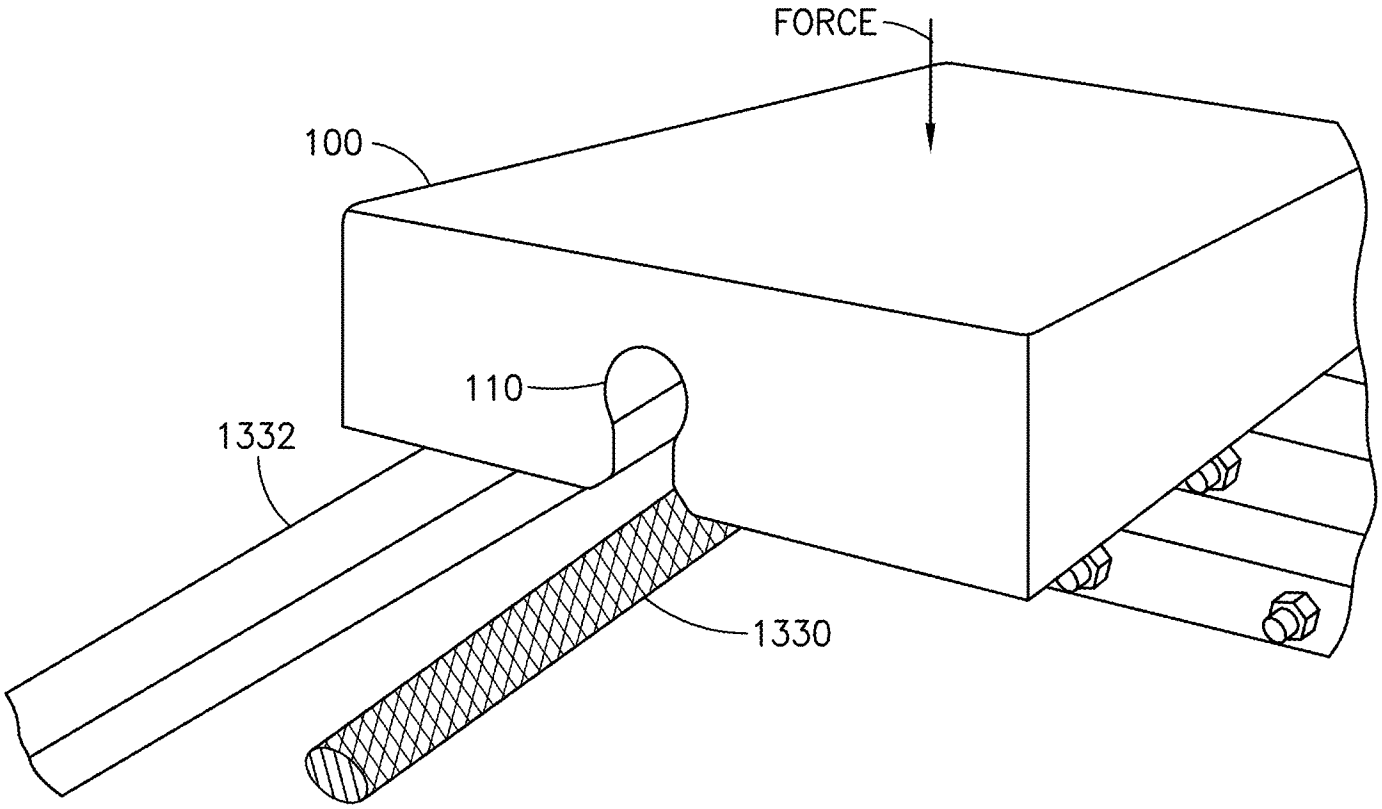
FIG. 13 is a perspective view showing an exemplary implementation of the exercise pad in FIG. 1 adjacent to a horizontally-disposed bar, which in the illustrated example, is barbell resting on a weightlifting rack.

FIG. 13 is a perspective view showing an exemplary implementation of exercise pad 100 adjacent to a horizontally-disposed bar, which in the illustrated example, is barbell 1330 resting on a weightlifting rack 1332.

The groove 110 of the exercise pad 100 is shown aligned with and directly above the barbell 1330, such that applying a force in the direction indicated by the arrow labeled "FORCE" will urge the exercise pad 100 in a downward direction and into engagement with the barbell 1330. Once engaged, the barbell 1330 sits within and extends through the lower (circular) portion of the groove 110 and is held in place there by the narrower upper (entrance) portion of the groove 110. The barbell 1330 is supported by the weightlifting rack (e.g., by a pair of J hooks, or the like). So, when the downward force is applied to the exercise pad 100, the exercise pad 100 moves in a downward direction, pressing onto the barbell 1330, but the barbell 1330 remains stationary.

Figure 14:
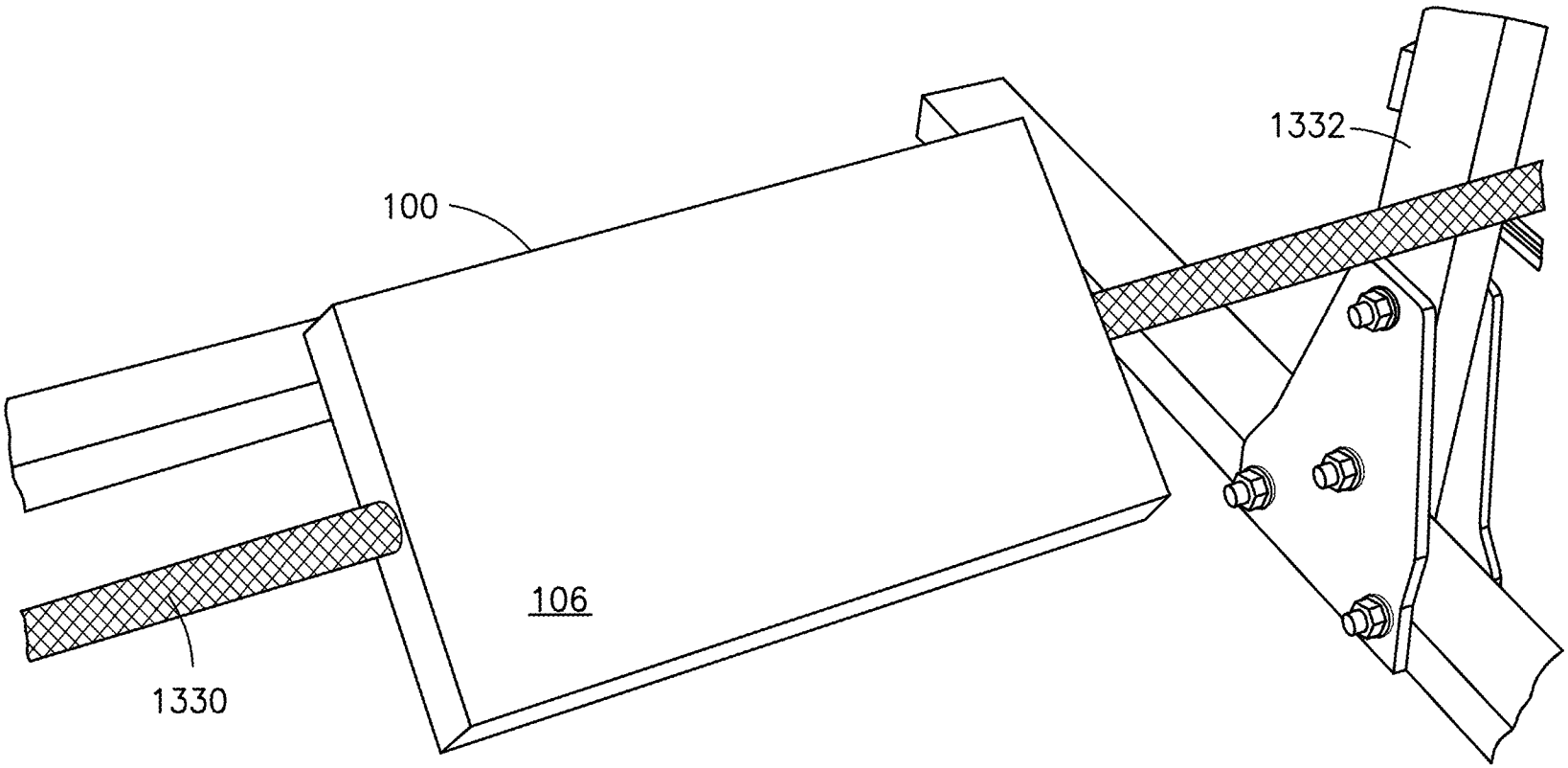
FIG. 14 is an alternative perspective view showing the exemplary implementation of the exercise pad of FIG. 1 coupled to a barbell, which is resting on, and supported by, a weightlifting rack.

FIG. 14 is an alternative perspective view showing the exemplary implementation of exercise pad 100 coupled to the barbell 1330, which is resting on, and supported by, the weightlifting rack 1332. Notably, the exercise pad 100, when so coupled, tends to remain coupled to the barbell 1330, but is also able to rotate (or pivot) about an axis defined by the barbell 1330.

Figure 15:
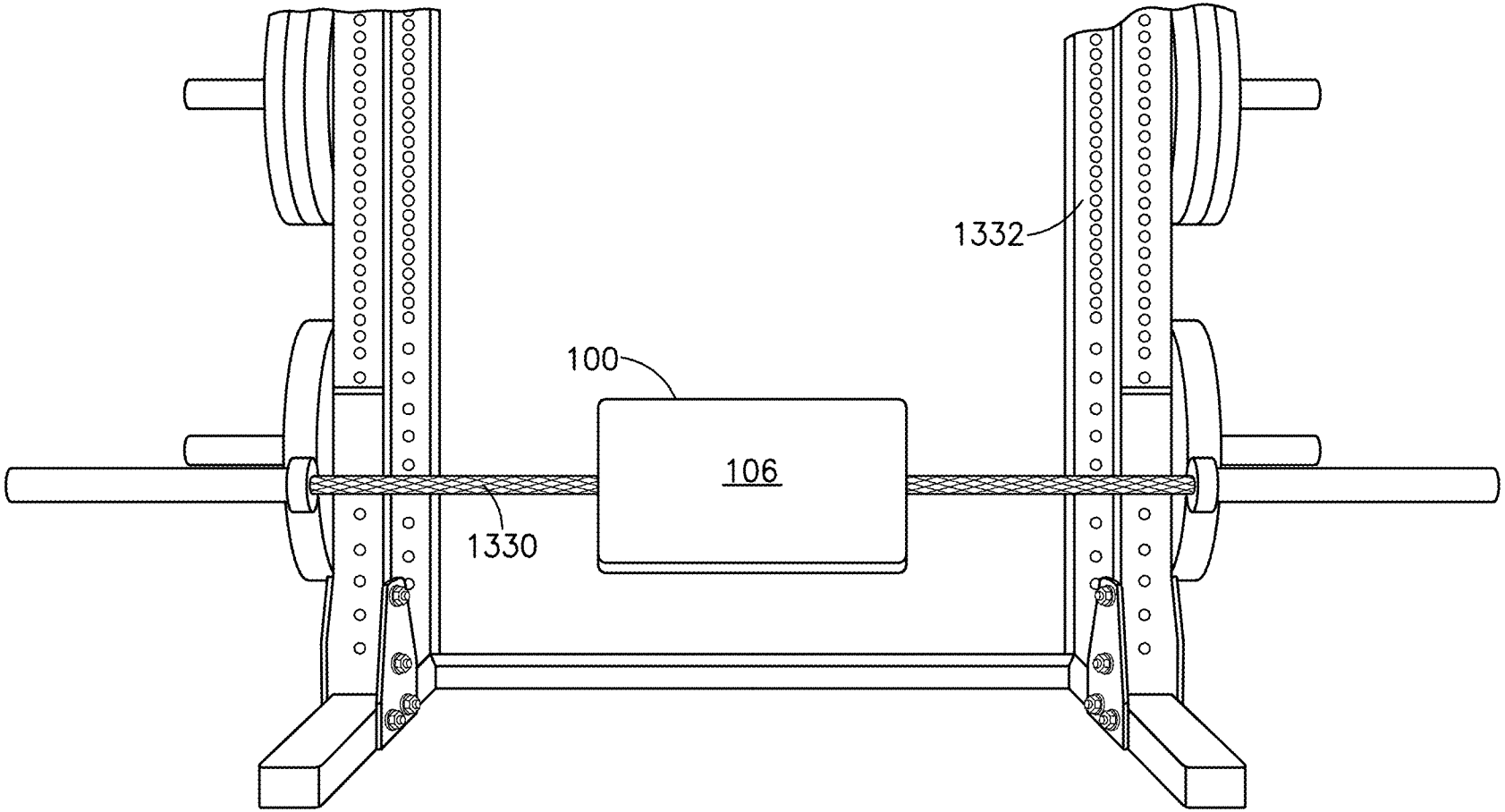
FIG. 15 is yet another alternative perspective view showing the exemplary implementation of the exercise pad of FIG. 1 coupled to the barbell, which is resting on, and supported by, the weightlifting rack.

FIG. 15 is yet another alternative perspective view showing the exemplary implementation of exercise pad 100 coupled to the barbell 1330, which is resting on, and supported by, the weightlifting rack 1332. As mentioned above, the exercise pad 100, when so coupled, tends to remain coupled to the barbell 1330, but is also able to rotate (or pivot) about an axis defined by the barbell 1330. In fact, it can be seen that the configuration of the exercise pad 100 in FIG. 15 is different than the configuration of the exercise pad 100 in FIG. 14. More specifically, the second major surface 106 of the exercise pad 100, for example, is approximately vertical in FIG. 15, but is much closer to horizontal in FIG. 14. To reach the configuration in FIG. 15 from the configuration in FIG. 14 (or vice versa), the exercise pad 100 may rotate (or pivot) about a longitudinal axis of the barbell 1330.

Figure 16A:
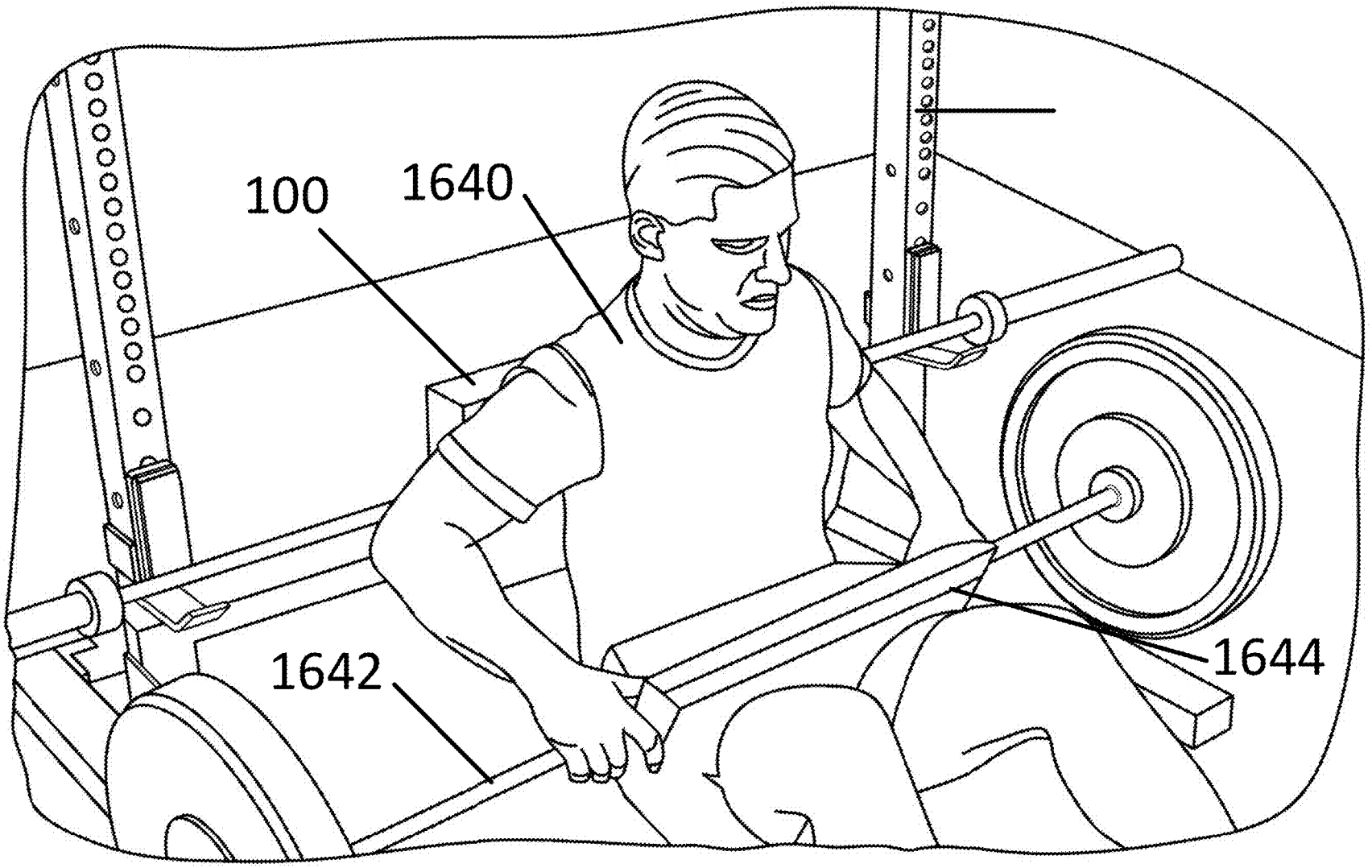
FIGS. 16A and 16B are perspective views showing a non-limiting example of the exercise pad of FIG. 1 in use, by an exerciser performing hip thrusts.
Figure 16B:
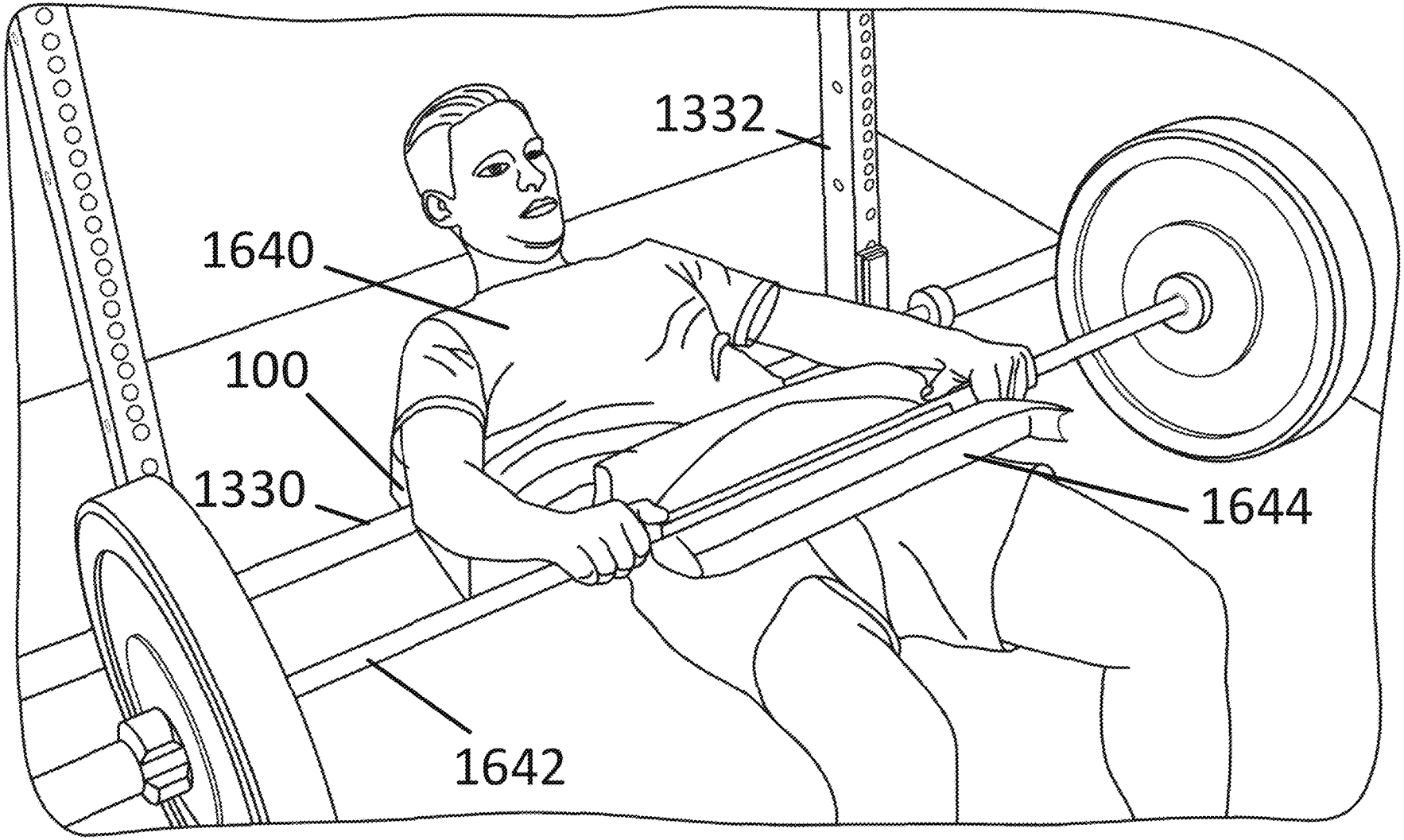

FIGS. 16A and 16B show a non-limiting example of the exercise pad 100 in use. The exercise pad 100 in the illustrated example is coupled to a barbell 1330, which is resting on, and supported by, a weightlifting rack 1332. An exerciser 1640 is using the exercise pad 100 in the indicated configuration to perform a hip thrust, with a second weighted barbell 1642 resting across his hips or pelvis on a pad 1644.

At the start of the hip thrust (represented in FIG. 16A), the exerciser's 1640 feet would be flat on the ground and the exerciser's 1640 knees would be up, creating a V-shape between the exerciser's thighs and torso. The exerciser 1640 hinges back and thrusts the weight on the exerciser's 1640 pelvis upward until the exerciser 1640 straightens out the V-shape originally between the exerciser's 1640 thighs and torso to create a table-like position (represented in FIG. 16B) where the exerciser's 1640 feet remain flat on the ground, the exerciser's 1640 back is resting on top of the corner of the bench, the exerciser's 1640 posterior is elevated off the ground and the exerciser's 1640 legs form a substantially 90 degrees angle. The exerciser 1640 then returns to the position shown in FIG. 16A.

Throughout the indicated hip thrust, the exercise pad 100 remains coupled to, and rotates (pivots) about a longitudinal axis of, the barbell 1330. The exercise pad 100 provides continual and reliable support to the exerciser 1640 throughout the entire exercise.

Figure 17:
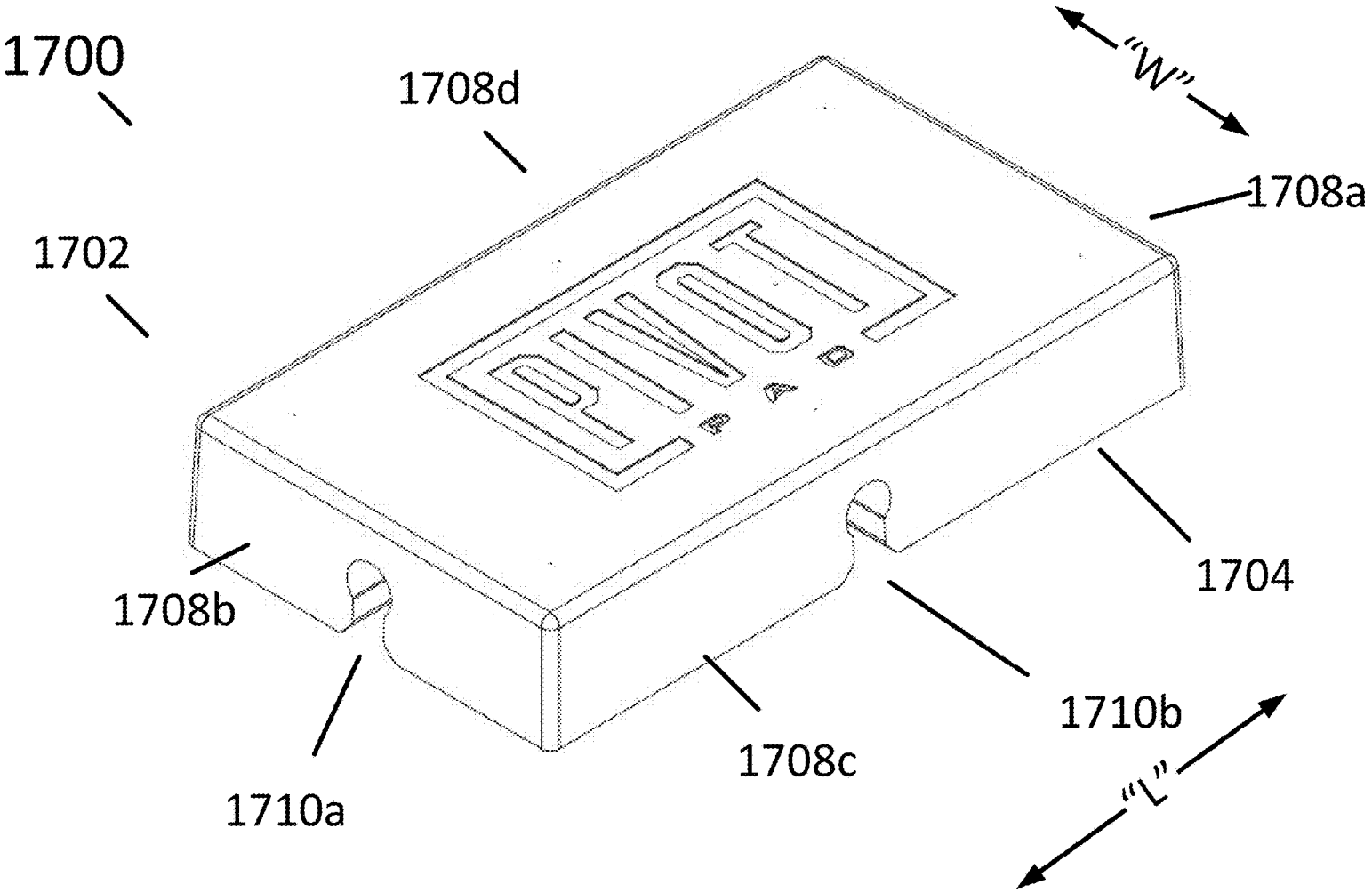
FIG. 17 is a perspective view of an alternative exercise pad.

FIG. 17 is a perspective view of an alternative exercise pad 1700. The alternative exercise pad 1700 is similar to the exercise pads described elsewhere herein (e.g., exercise pad 100), except that exercise pad 1700 has multiple grooves 1710*a*, 1710*b*, instead of just one, formed in the first major surface 1704 of the body 1702. The first groove 1710*a* extends across the body 1702 in the longitudinal direction ("L") between a first side surface 1708*a* and a second side surface 1708*b* and essentially bisects a first major surface 1704 of the exercise pad 1700. More specially, the first groove 1710*a* in the illustrated implementation is centered on the first major surface 1704 equidistant between the third side surface 1708*c* and the fourth side surface 1708*d* along its entire length. The upper edges of the third side surface 1708*c* and the fourth side surface 1708*d*, in the illustrated implementation, are parallel to the upper edges of the first groove 1710*a*. The second groove 1710*b* extends across the body 1702 in the width direction ("W") between the third side surface 1708*c* and the fourth side surface 1708*d* and essentially bisects the first major surface 1704 of the exercise pad 1700. More specially, the second groove 1710*b* in the illustrated implementation is centered on the first major surface 1704 equidistant between the first side surface 1708*a* and the second side surface 1708*b* along its entire length. The upper edges of the first side surface 1708*a* and the second side surface 1708*b*, in the illustrated implementation, are parallel to the upper edges of the second groove 1710*b*. Although not visible in FIG. 17, the first groove 1710*a*, 1710*b* intersect one another. Moreover, each of these grooves 1710*a*, 1710*b* has the same cross-sectional size and shape as the other.

Adding multiple grooves to the exercise pad—especially in perpendicular directions from one another, as represented in FIG. 17—enhances the utility and flexibility of the pad as a device that can be used to support an exerciser or parts of an exerciser as he or she performs exercisers. The added flexibility comes from the fact that the pivot pad can be coupled to a barbell, for example, using either groove and, therefore, be oriented to provide wide support for the exerciser or narrower support for the exerciser.

Figure 18B:
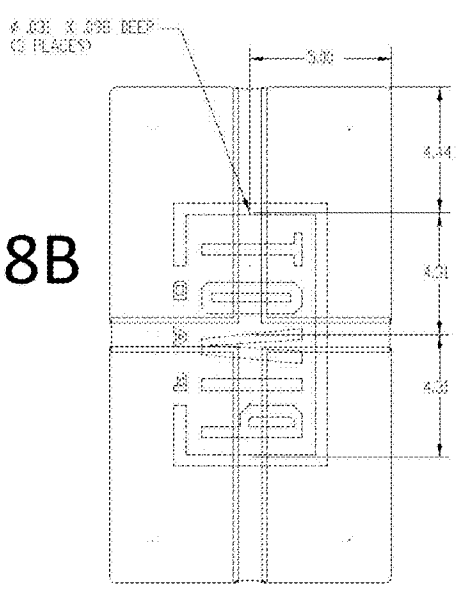
FIG. 18A-18D are views of the alternative exercise pad of FIG. 17, showing various dimensions, particular only to the illustrated implementation.
Figure 18A:
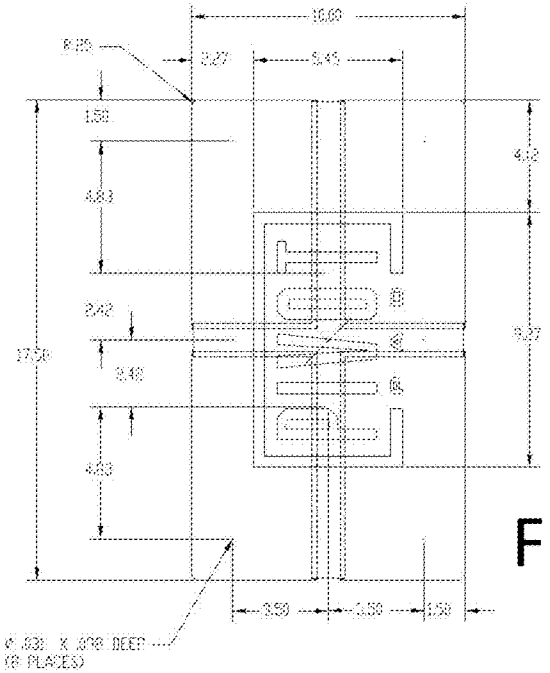
Figure 18D:
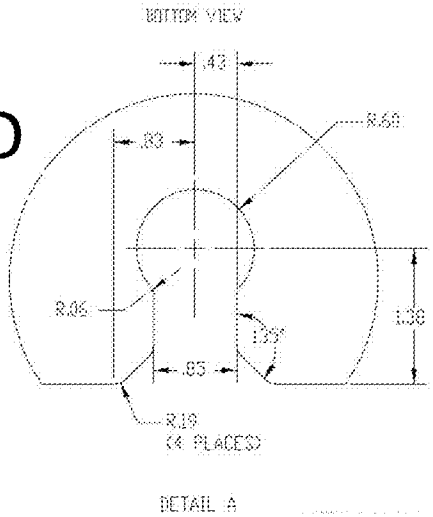
Figure 18C:
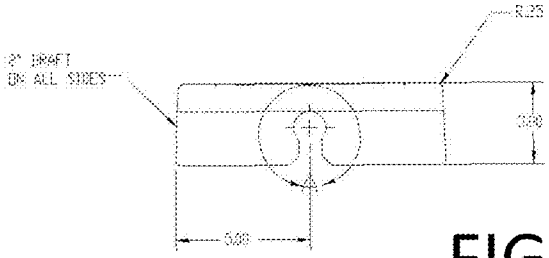

FIG. 18A-18D are views of the alternative exercise pad of FIG. 17, showing various dimensions, particular only to the illustrated implementation. It is important to note that the dimensions represented in these figures are exemplary only. Each dimension can vary considerably (e.g., by at least 10% or more). The dimensions shown in these figures, or anywhere else in the specification, should not be considered as limiting the scope of coverage that might otherwise be provided in the application. The top view in FIG. 18A and the bottom view of FIG. 18B are transparent so that the "Pivot Pad" markings on the top of the exercise pad and an outline of the grooves on the bottom of the exercise pad can be viewed in both.

A number of embodiments of the invention have been described. Nevertheless, it will be understood that various modifications may be made without departing from the spirit and scope of the invention.

For example, the exercise pad disclosed herein can be used for any one of a variety of strength-building exercises. For example, in addition to hip thrusts, the exercise pad can be used to support an exerciser while the exerciser performs any one of a variety of presses, or other weightlifting movements. The exercise pad can be configured to engage a standard weightlifting barbell (with a cylindrical center portion, knurled or otherwise, for engaging the exercise pad) having a diameter of 24 millimeters to 29 millimeters (or 25 millimeters to 28 millimeters), for example, or any barbell or other elongate rigid structure able to perform the functionalities of engaging the exercise pad and supporting an exerciser using the exercise pad to perform an exercise. In one exemplary implementation, the keyhole design is substantially centered within the pad and has a diameter of 1.25" at its widest point to accommodate a loose fit around a 24 millimeter to 29 millimeter barbell (or a 25 millimeter to 28 millimeter barbell).

A variety of materials or combinations thereof may be used to manufacture the exercise pad disclosed herein.

The physical configuration of the exercise pad can vary. For example, the size, relative and absolute, of the various portions (e.g., surfaces, edges, etc.) of the exercise pad can be larger or smaller than what was described herein. The size, shape, and location of the groove in the exercise pad can vary. For example, the groove can be deeper or shallower than what is described here, the groove can be wider or narrower—either at the entrance, the lower portion, or both—than what is described here, the groove can be off-centered (e.g., closer to one side than the other), and/or the groove can extend across a surface of the exercise pad in a shorter direction (e.g., in the "W" direction of FIG. 1, rather than the "L" direction of FIG. 1). In some implementations, the exercise pad may include multiple grooves (e.g., two, as described, or more). In some such implementations, the multiple grooves may be arranged to on the same surface as, and parallel to (or perpendicular to), each other.

Specific and relative dimensions can vary across wide ranges. In various implementations, the ratio of the diameter of the circular path (that the curved surface at the bottom of the groove follows) to the distance between the parallel portions of the pair of surfaces in the first portion is between 1.4 to 0.8 and 1.1 to 0.9. The diameter of the circular path is between 1.1 and 1.4 inches (e.g., 1.25 inches). In some implementations, the distance between the parallel portions of the pair of surfaces in the first portion is at least 0.8 inches and no greater than 1.1 inches. In some implementations, the distance between the parallel portions of pair of surfaces in the first portion is at least 0.9 inches and no greater than 1.0 inches. In some implementations, the distance between the parallel portion of the pair of surfaces is 1 inch and the diameter of the circular path is 1.25 inches. 13. The keyhole shape of the groove may have a depth of between 1.7 inches and 2.3 inches from a plane of the first major surface.

In various implementations, the shape of the edges of the exercise pad may vary. Essentially, any edge may be rounded, any edge may be beveled, any edge may include a sharp angle (e.g., 90 degrees or otherwise), and any edge may be any other shape, or include any combination of the foregoing.

In various implementations, the first major surface, the second major surface, and all the side surfaces are textured. However, in other implementations, these surfaces may be smooth. In various implementations, the inner surface of groove is smooth. However, in other implementations, this surface could be textured.

The specific physical configuration of the rigid core can vary. For example, the rigid core could be longer or shorter than what is described herein, wider of narrower than what is described herein, and/or thicker or thinner than what is described herein. Room for variation in this regard may be, for example, +/−5%. The size, shape, number of, and arrangement of apertures in the rigid core can vary. The apertures may be smaller or larger than what is described herein (e.g., by +/−5%). The apertures can have a cross-sectional shape that is round, square, rectangular, rounded rectangular, triangular, pentagonal, hexagonal, etc. Moreover, in some implementations, the apertures can have non-uniform shapes. The number of apertures can vary from zero to many (e.g., 20 or more). Their arrangement can be uniformly distributed (e.g., in an array, or columns, etc.) or randomly distributed. Moreover, in some implementations, different apertures in the rigid core may have different sizes and/or shapes. Additionally, although the rigid core configurations disclosed herein are flat, the rigid core need not be flat.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Other implementations are within the scope of the claims.

What is claimed is:

1. An exercise pad comprising:

a body comprising:

a first major surface;

a second major surface parallel to the first major surface;

side surfaces that extend between the first major surface and the second major surface, and a first groove formed in the first major surface of the body, wherein the first groove extends across the body in a longitudinal direction from a first one of the side surfaces to a second one of the side surfaces that is opposite to and parallel to the first one of the side surfaces, and wherein the first groove is configured to receive and engage an elongate bar, wherein the body comprises a foam material, and wherein the body further comprises a rigid core inside the foam material.

2. The exercise pad of claim 1, wherein the first groove is straight and has a uniform cross-sectional shape across an entire length of the first groove from the first one of the side surfaces to the second one of the side surfaces.

3. The exercise pad of claim 1, wherein the first groove is centered on the first major surface of the body equidistant between a third one of the side surfaces and a fourth one of the side surfaces along an entire length of the first groove.

4. The exercise pad of claim 1, wherein the cross-sectional shape of the first groove is a keyhole shape.

5. The exercise pad of claim 4, wherein the keyhole shape comprises:

a first portion defined by a pair of surfaces that extend from the first major surface down into the body; and a second portion defined by a curved surface that extends between a bottom end of the pair of surfaces.

6. The exercise pad of claim 5, wherein the curved surface in the second portion of the keyhole shape follows a circular path, and wherein the circular path has a diameter that is larger than a distance between the pair of surfaces in the first portion.

7. The exercise pad of claim 6, wherein the diameter of the circular path is between 1.1 and 1.4 inches.

8. The exercise pad of claim 6, wherein the distance between the pair of surfaces in the first portion is at least 0.8 inches and no greater than 1.1 inches.

9. The exercise pad of claim 8, wherein the distance between the pair of surfaces in the first portion is at least 0.9 inches and no greater than 1.0 inches.

10. The exercise pad of claim 5, wherein the keyhole shape has a depth of between 1.7 inches and 2.3 inches from a plane of the first major surface.

11. The exercise pad of claim 5, wherein the pair of surfaces that define the first portion of the keyhole shape comprise:

a first section in which the pair of surfaces are parallel to one another; and a second section above the first section that forms a bevel or curve that extends between the first section and the first major surface of the exercise pad.

12. The exercise pad of claim 1, wherein the first groove is centered on the first major surface equidistant, along an entire length of the first groove, between a first outer edge of the first major surface that is parallel to the first groove and a second outer edge of the first major surface that is parallel to the first groove.

13. The exercise pad of claim 1, wherein the first major surface comprises outer edges of the exercise pad and upper edges of the first groove, wherein the outer edges of the first major surface and the upper edges of the first groove surround respective portions of the first major surface, and wherein the respective portions of the first major surface are planar and substantially uniform between the outer edges of the first major surface and the upper edges of the first groove.

14. The exercise pad of claim 1, wherein the second major surface comprises four outer edges that surround a rectangular surface that is planar and substantially uniform between all of the four outer edges.

15. The exercise pad of claim 1, wherein the first one of the side surfaces comprises four outer edges of the exercise pad and an edge of the first groove, which interrupts one of the outer edges of the exercise pad, wherein the four outer edges of the exercise pad and the edge of the first groove, surround a surface that is planar and substantially uniform between the four outer edges of the exercise pad and the edge of the first groove on the first side surface.

16. The exercise pad of claim 1, wherein a third one of the side surfaces comprises four outer edges that surround a rectangular surface that is planar and substantially uniform between all of the four outer edges of the third one of the side surfaces.

17. The exercise pad of claim 1, wherein the foam material comprises a molded dense polyurethane foam, or a dense crosslink polyethylene foam.

18. The exercise pad of claim 1, wherein the body comprises a polyurethane foam surrounding the rigid core.

19. The exercise pad of claim 1, wherein the rigid core comprises a material selected from the group consisting of plastic, metal, wood, fiberglass, and other rigid composites.

20. The exercise pad of claim 1, wherein the body comprises a material selected from the group consisting of rubber, plastic, and silicone.

21. The exercise pad of claim 1, wherein the body has a length between 8 inches and 30 inches, a width between 6 inches and 20 inches, and a height between 1.5 inches and 7 inches.

22. The exercise pad of claim 1, further comprising:

a second groove formed in the first major surface of the body, wherein the second groove extends across the body in a width direction, perpendicular to the longitudinal direction, from a third one of the side surfaces to a fourth one of the side surfaces that is opposite to and parallel to the third one of the side surfaces.

23. An assembly comprising:

a support structure;

an elongate cylindrical bar supported by the support structure; and an exercise pad coupled to the elongate cylindrical bar, the exercise pad comprising:

a body comprising:

a first major surface;

a second major surface parallel to the first major surface;

side surfaces that extend between the first major surface and the second major surface, and a first groove formed in the first major surface of the body, wherein the first groove extends across the body in a longitudinal direction from a first one of the side surfaces to a second one of the side surfaces that is opposite to and parallel to the first one of the side surfaces, and wherein the first groove is configured to receive and engage an elongate cylindrical bar, wherein the body comprises a foam material, and wherein the body further comprises a rigid core inside the foam material; and wherein the exercise pad is coupled to the elongate cylindrical bar by virtue of the elongate cylindrical bar having been positioned inside the first groove of the exercise pad so as to extend in the longitudinal direction.

24. The assembly of claim 23, wherein the elongate cylindrical bar is a barbell, and wherein the support structure is a weightlifting rack.

25. The assembly of claim 24, wherein opposite ends of the barbell extend beyond the first groove past the first one of the side surfaces of the body and the second one of the side surfaces of the body, respectively.

26. The assembly of claim 24, wherein the support structure comprises a pair of hooks or other rigid surfaces that form part of a weightlifting rack, and the barbell is in direct physical contact with, and supported by, the pair of hooks or other rigid surface.

27. The assembly of claim 23, wherein the exercise pad further comprises:

a second groove formed in the first major surface of the body, wherein the second groove extends across the body in a width direction, perpendicular to the longitudinal direction, from a third one of the side surfaces to a fourth one of the side surfaces that is opposite to and parallel to the third one of the side surfaces.

28. The assembly of claim 23, wherein the body of the exercise pad comprises a polyurethane foam surrounding the rigid core.

29. The assembly of claim 28, wherein the rigid core comprises a material selected from the group consisting of plastic, metal, wood, fiberglass, and other rigid composites.

30. A method of exercising comprising:

positioning the elongate cylindrical bar on a support structure, providing an exercise pad comprising:

a body comprising:

a first major surface;

a second major surface parallel to the first major surface;

side surfaces that extend between the first major surface and the second major surface, and a first groove formed in the first major surface of the body, wherein the first groove extends across the body in a longitudinal direction from a first one of the side surfaces to a second one of the side surfaces that is opposite to and parallel to the first one of the side surfaces, wherein the first groove is configured to receive and engage an elongate cylindrical bar, wherein the body comprises a foam material, and wherein the body further comprises a rigid core inside the foam material;

coupling the exercise pad to the elongate cylindrical bar;

supporting at least part of a human's weight with the exercise pad while the exercise pad is coupled to the elongate cylindrical bar; and performing an exercise while the human's weight is being at least partially supported on the exercise pad that is coupled to the elongate cylindrical bar.

31. The method of claim 30, wherein coupling the exercise pad to the elongate cylindrical bar comprises:

aligning the elongate cylindrical bar with a longitudinal entrance at a top of the first groove; and pressing the exercise pad onto the elongate cylindrical bar until the elongate cylindrical bar enters the first groove through the longitudinal entrance, wherein the elongate cylindrical bar, once pressed onto the elongate cylindrical bar, lies within the first groove in the longitudinal direction, extending beyond the first groove in opposite directions.

32. The method of claim 30, wherein the exercise pad pivots about an axis defined by the elongate cylindrical bar as the exercise is being performed.

33. The method of claim 30, wherein the exercise is a hip thrust.

34. The method of claim 30, wherein the exercise pad further comprises:

a second groove formed in the first major surface of the body, wherein the second groove extends across the body in a width direction, perpendicular to the longitudinal direction, from a third one of the side surfaces to a fourth one of the side surfaces that is opposite to and parallel to the third one of the side surfaces the method further comprising:

removing the elongate cylindrical bar from the first groove; and coupling the exercise pad to the elongate bar in the second groove.

35. The method of claim 30, wherein the body of the exercise pad comprises a polyurethane foam surrounding the rigid core.

36. The method of claim 35, wherein the rigid core comprises a material selected from the group consisting of plastic, metal, wood, fiberglass, and other rigid composites.

* * * * *